US006727877B2

(12) United States Patent
Itakura

(10) Patent No.: US 6,727,877 B2
(45) Date of Patent: Apr. 27, 2004

(54) LIQUID CRYSTAL DISPLAY DEVICE AND METHOD OF DRIVING THE SAME

(75) Inventor: Kunimasa Itakura, Tokyo (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 34 days.

(21) Appl. No.: 09/927,756

(22) Filed: Aug. 10, 2001

(65) Prior Publication Data

US 2002/0126076 A1 Sep. 12, 2002

(30) Foreign Application Priority Data

Aug. 11, 2000 (JP) ..... 2000-245220

(51) Int. Cl.[7] ..... G09G 3/36

(52) U.S. Cl. ..... 345/94; 345/87; 345/89; 345/209; 345/210; 345/690

(58) Field of Search ..... 345/87, 89, 94–96, 345/209–210, 690

(56) References Cited

U.S. PATENT DOCUMENTS 5,640,174 A * 6/1997 Kamei et al. ..... 345/89
5,923,312 A * 7/1999 Okada et al. ..... 345/95
6,118,421 A * 9/2000 Kawaguchi et al. ..... 345/89
6,266,116 B1 * 7/2001 Ohta et al. ..... 349/141
6,310,667 B1 * 10/2001 Nakayoshi et al. ..... 349/42

* cited by examiner

*Primary Examiner*—Kent Chang
*Assistant Examiner*—Tom Sheng
(74) *Attorney, Agent, or Firm*—Scully, Scott, Murphy & Presser

(57) ABSTRACT

A liquid crystal display device includes a first substrate, a second substrate, a liquid crystal layer sandwiched between the first and second substrates, a plurality of scanning lines arranged on the first substrate, a plurality of signal lines arranged on the first substrate, a plurality of first switches arranged at intersections of the scanning lines and the signal lines, a plurality of pixel electrodes each electrically connected to each of the first switches, a plurality of opposing electrodes each arranged in parallel with each of the pixel electrodes, and a signal line driver which switches a first voltage for driving a positive pole and a second voltage for driving a negative pole at a predetermined interval in accordance with a gradation, and outputs the positive or negative driving voltage to the signal lines, the signal line driver compensating for the first and second voltages such that averages of the first and second voltages in each of gradations are different from one another.

19 Claims, 30 Drawing Sheets

| GRADATION | REFERENCE | POSITIVE POLE | NEGATIVE POLE | AVERAGE | GRADATION COMPENSATION |
|---|---|---|---|---|---|
| 255 | REFERENCE 1 | 10.50V | 0.10V | 5.3V | −0.5V |
| 254 | REFERENCE 2 | 9.52V | 1.18V | 5.35V | −0.45V |
| 240 | REFERENCE 3 | 9.01V | 1.79V | 5.4V | −0.4V |
| 192 | REFERENCE 4 | 8.36V | 2.64V | 5.5V | −0.3V |
| 128 | REFERENCE 5 | 7.73V | 3.47V | 5.6V | −0.2V |
| 64 | REFERENCE 6 | 6.95V | 4.45V | 5.7V | −0.1V |
| 32 | REFERENCE 7 | 6.30V | 5.30V | 5.8V | 0.0V |
| 0 | REFERENCE 8 | 5.80V | 5.80V | 5.8V | 0.0V |

FIG.16

| GRADATION | REFERENCE | POSITIVE POLE | NEGATIVE POLE | AVERAGE | GRADATION COMPENSATION |
|---|---|---|---|---|---|
| 255 | REFERENCE 1 | 10.50V | 0.10V | 5.3V | −0.5V |
| 254 | REFERENCE 2 | 9.52V | 1.18V | 5.35V | −0.45V |
| 240 | REFERENCE 3 | 9.01V | 1.79V | 5.4V | −0.4V |
| 192 | REFERENCE 4 | 8.36V | 2.64V | 5.5V | −0.3V |
| 128 | REFERENCE 5 | 7.73V | 3.47V | 5.6V | −0.2V |
| 64 | REFERENCE 6 | 6.95V | 4.45V | 5.7V | −0.1V |
| 32 | REFERENCE 7 | 6.30V | 5.30V | 5.8V | 0.0V |
| 0 | REFERENCE 8 | 5.80V | 5.80V | 5.8V | 0.0V |

FIG.18

| GRADATION | REFERENCE | POSITIVE POLE | NEGATIVE POLE | AVERAGE | GRADATION COMPENSATION |
|---|---|---|---|---|---|
| 255 | REFERENCE 1 | 11.00V | 0.60V | 5.8V | – |
| 254 | REFERENCE 2 | 9.97V | 1.63V | 5.8V | – |
| 240 | REFERENCE 3 | 9.41V | 2.19V | 5.8V | – |
| 192 | REFERENCE 4 | 8.66V | 2.94V | 5.8V | – |
| 128 | REFERENCE 5 | 7.93V | 3.67V | 5.8V | – |
| 64 | REFERENCE 6 | 7.05V | 4.55V | 5.8V | – |
| 32 | REFERENCE 7 | 6.30V | 5.30V | 5.8V | – |
| 0 | REFERENCE 8 | 5.80V | 5.80V | 5.8V | – |

FIG.28

| GRADATION | REFERENCE | POSITIVE POLE | NEGATIVE POLE | AVERAGE | GRADATION COMPENSATION |
|---|---|---|---|---|---|
| 255 | REFERENCE 1 | 10.70 V | 0.30 V | 5.5 V | -0.3 V |
| 254 | REFERENCE 2 | 9.72 V | 1.38 V | 5.55 V | -0.25 V |
| 240 | REFERENCE 3 | 9.21 V | 1.99 V | 5.60 V | -0.2 V |
| 192 | REFERENCE 4 | 8.51 V | 2.79 V | 5.65 V | -0.15 V |
| 128 | REFERENCE 5 | 7.83 V | 3.57 V | 5.7 V | -0.1 V |
| 64 | REFERENCE 6 | 7.05 V | 4.55 V | 5.8 V | 0.0 V |
| 32 | REFERENCE 7 | 6.30 V | 5.30 V | 5.8 V | 0.0 V |
| 0 | REFERENCE 8 | 5.80 V | 5.80 V | 5.8 V | 0.0 V |

FIG.33

| Vdr(V) | −0.9 | −0.5 | −0.3 | −0.1 | 0.0 | 0.3 |
|---|---|---|---|---|---|---|
| FLICKER TIME (sec) | 1 | 3.2 | 6.4 | 9.8 | 10 | 15.2 |

LIQUID CRYSTAL DISPLAY DEVICE AND METHOD OF DRIVING THE SAME

BACKGROUND OF THE INVENTION

1. Field of the Invention

The invention relates to a liquid crystal display device, and more particularly to an active matrix type in-plane switching liquid crystal display device.

2. Description of the Related Art

Recently, there has been developed an in-plane switching type liquid crystal display device in which molecular axes of aligned liquid crystal molecules are rotated in a plane parallel to a substrate, to thereby display images.

In an in-plane switching type liquid crystal display device, since a viewer looks only at minor axes of liquid crystal molecules even if he/she turns his/her viewpoint, an angle of visibility is not dependent on an inclination of liquid crystal molecules. Hence, an in-plane switching type liquid crystal display device can present a wider angle of visibility than a conventional liquid crystal display device such as a twisted nematic (TN) mode liquid crystal display device where an electric field is generated between substrates sandwiching a liquid crystal layer therebetween in a direction perpendicular to the substrates.

In an in-plane switching type liquid crystal display device, a plurality of scanning lines and signal lines are arranged on one of transparent substrates sandwiching a liquid crystal layer therebetween. Thin film transistors (TFTs) are arranged at intersections of the scanning and signal lines. Sources of the thin film transistors are electrically connected to pixel electrodes. Opposing electrodes are positioned in facing relation with the pixel electrodes.

When an image is displayed on a display screen in in-plane switching type liquid crystal display device, a voltage is applied to the scanning lines for successively turning the thin film transistors on, and then, a voltage having a magnitude determined in accordance with a gradation to be displayed is applied to an associated pixel electrode through the thin film transistor from a data line. As a result, there is produced an electric field between the pixel and opposing electrodes in parallel with the transparent substrates. The thus produced electric field varies a direction of alignment of liquid crystal molecules in the liquid crystal layer, and resultingly, vary optical characteristics of liquid crystal, ensuring a desired gradation.

The above-mentioned in-plane switching type liquid crystal display device is accompanied with a problem that flicker occurs when a certain image is displayed for a certain period of time, and thereafter, the image is switched into another image in which all pixels are arranged to be in the same gradation.

For instance, it is assumed that a liquid crystal display device is driven in accordance with a dot inversion driving method in which a voltage for driving a positive polarity and a voltage for driving a negative polarity are switched to each other in each of pixels at a predetermined interval. In this case, the above-mentioned problem occurs in particular when a checker pattern in which black-displaying pixels B (minimum gradation) and white-displaying pixels W (maximum gradation) are alternately arranged in a matrix, as illustrated in FIG. 7, is displayed in a certain period of time, and thereafter, all pixels are switched into images having the same gradation.

For another instance, it is assumed that a liquid crystal display device is driven in accordance with a line inversion driving method in which a voltage for driving a positive polarity and a voltage for driving a negative polarity are switched to each other in every lines at a predetermined interval. In this case, the above-mentioned problem occurs in particular when a stripe pattern in which black-displaying and white-displaying pixels are alternately arranged in every two lines is displayed in a certain period of time, and thereafter, all pixels are switched into images having the same gradation.

SUMMARY OF THE INVENTION

In view of the above-mentioned problems in the conventional liquid crystal display devices, it is an object of the present invention to provide an in-plane switching type liquid crystal display device which is capable of reducing flickers in a display screen It is also an object of the present invention to provide a method of driving a liquid crystal display device which method is capable of reducing flickers in a display screen.

In one aspect of the present invention, a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate, (f) a plurality of first switches arranged at intersections of the scanning lines and the signal lines, (g) a plurality of pixel electrodes each electrically connected to each of the first switches, (h) a plurality of opposing electrodes each arranged in parallel with each of the pixel electrodes, and (i) a signal line driver which switches a first voltage for driving a positive pole and a second voltage for driving a negative pole at a predetermined interval in accordance with a gradation, and outputs the positive or negative driving voltage to the signal lines, the signal line driver compensating for the first and second voltages such that averages of the first and second voltages in each of gradations are different from one another.

For instance, the signal line driver may be designed to compensate for the first and second voltages such that an average of the first and second voltages is smaller in a higher gradation.

For instance, the signal line driver may be designed to compensate for the first and second voltages such that a difference between an average of positive and negative voltages to be applied to the pixel electrode in association with a gradation and a voltage of the opposing electrode associated with the pixel electrode is kept substantially constant irrespective of the gradation.

For instance, such a voltage may be applied to the opposing electrodes that a flicker is not allowed to occur in a display where pixels displaying intermediate gradation and pixels displaying black are alternately arranged. For instance, the signal line driver may be designed to compensate for the first and second voltages such that a difference between an average of the first and second voltages, associated with a maximum gradation, and an average of the first and second voltages, associated with a minimum gradation, is in the range of −1.0 to 0.0 volts both inclusive.

For instance, the signal line driver may be designed to compensate for the first and second voltages such that a difference between an average of the first and second voltages, associated with a maximum gradation, and an average of the first and second voltages, associated with a minimum gradation, is in the range −0.9 to −0.2 volts both inclusive.

For instance, the signal line driver may be designed to compensate for the first and second voltages such that a difference between an average of the first and second voltages, associated with a maximum gradation, and an average of the first and second voltages, associated with a minimum gradation, is in the range of −0.5 to −0.3 volts both inclusive.

It is preferable that the liquid crystal display device further includes a light barrier which does not allow a light to reach the first switches.

It is preferable that liquid crystal in the liquid crystal layer has a specific resistance in the range of $4.5\times10^{10}$ Ω cm and $2.0\times10^{13}$ Ω cm both inclusive, preferably in the range of $3.0\times10^{11}$ Ω cm and $1.0\times10^{13}$ Ω cm both inclusive, and more preferably in the range of $5.0\times10^{11}$ Ω cm and $2.0\times10^{12}$ Ωcm both inclusive.

There is further provided a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate, a plurality of first switches arranged at intersections of the scanning lines and the signal lines, (g) a plurality of pixel electrodes each electrically connected to each of the first switches, (h) a plurality of opposing electrodes each arranged in parallel with each of the pixel electrodes, (i) a signal line driver which switches a first voltage for driving a positive pole and a second voltage for driving a negative pole at a predetermined interval in accordance with a gradation, and outputs the positive or negative driving voltage to the signal lines, and (j) a reference driving voltage supplier which generates first and second reference driving voltages both compensated for in each of gradations, and associated with at least one specific gradation, the signal line driver compensating for the first and second voltages such that averages of the first and second voltages in each of gradations are different from one another, the signal line driver including a driving voltage calculator which receives at least one pair of the first and second reference driving voltages from the reference driving voltage supplier, and calculates and outputs the first and second reference driving voltages associated with a gradation to be displayed, based on the received first and second reference driving voltages.

There is still further provided a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate, (If a plurality of first switches arranged at intersections of the scanning lines and the signal lines, (g) a plurality of pixel electrodes each electrically connected to each of the first switches, (h) a plurality of opposing electrodes each arranged in parallel with each of the pixel electrodes, (i) a signal line driver which switches a first voltage for driving a positive pole and a second voltage for driving a negative pole at a predetermined interval in accordance with a gradation, and outputs the positive or negative driving voltage to the signal lines, and (j) a reference driving voltage supplier which generates first and second reference driving voltages both compensated for in each of gradations, the signal line driver compensating for the first and second voltages such that averages of the first and second voltages in each of gradations are different from one another, the signal line driver including a driving voltage selector which receives the first and second reference driving voltages from the reference driving voltage supplier, and selects and outputs first and second reference driving voltages associated with a gradation to be displayed, among the received first and second reference driving voltages.

There is yet further provided a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate (f) a plurality of first switches arranged at intersections of the scanning lines and the signal lines, (g) a plurality of pixel electrodes each electrically connected to each of the first switches, (h) a plurality of opposing electrodes each arranged in parallel with each of the pixel electrodes, and (i) a signal line driver which switches a first voltage for driving a positive pole and a second voltage for driving a negative pole at a predetermined interval in accordance with a gradation, and outputs the positive or negative driving voltage to the signal lines, the signal line driver compensating for the first and second voltages such that averages of the first and second voltages in each of gradations are different from one another, the signal line driver including (i-1) a memory storing first and second voltages having been compensated for in each of gradations, (i-2) a driving voltage detector which receives the first and second voltages in a digital form from the memory, in association with a gradation to be displayed, and outputs the thus received digital first and second voltages, and (i-3) a digital-analog converter which receives the digital first and second voltages from the driving voltage detector, converts the thus received digital first and second voltages into analog first and second voltages, and outputs the analog first and second voltages.

There is still yet further provided a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate, (f) a plurality of first switches arranged at intersections of the scanning lines and the signal lines, (g) a plurality of pixel electrodes each electrically connected to each of the first switches, (h) a plurality of opposing electrodes each arranged in parallel with each of the pixel electrodes, and (i) a signal line driver which switches a first voltage for driving a positive pole and a second voltage for driving a negative pole at a predetermined interval in accordance with a gradation, and outputs the positive or negative driving voltage to the signal lines, the signal line driver compensating for the first and second voltages such that averages of the first and second voltages in each of gradations are different from one another, the signal line driver including (i-1) a driving voltage supplier which generates a driving voltage in accordance with a gradation to be displayed, (i-2) a compensation supplier which generates a compensation voltage associated with the gradation, and (i-3) an adder which adds the driving voltage transmitted from the driving voltage supplier and the compensation voltage transmitted from the compensation supplier to each other.

There is further provided a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate (f) a plurality of first switches arranged at intersections of the scanning lines and the signal lines, (g) a plurality of pixel electrodes each electrically connected to each of the first switches, (h) a plurality of opposing electrodes each arranged in parallel with each of the pixel electrodes, (i) a signal line driver which switches a first voltage for driving a positive pole and a second voltage for driving a negative pole at a predetermined interval in accordance with a gradation, and outputs the positive or negative driving voltage to the signal lines, and (j) a light source positioned at the opposite side of the liquid crystal layer about the first substrate, and (k) a brightness detector which detects a brightness of light emitted from the light source, the signal line driver compensating for the first and second voltages such that averages of the first and second voltages in each of gradations are different from one another, the signal line driver including a compensator which further compensates for the compensated first and second voltages, based on the brightness detected by the brightness detector.

It is preferable that the signal line driver compensates for the first and second voltages by adding a compensation voltage to the first and second voltages, the compensation voltage V1 being defined in accordance with the following equation:

$$Vi=V\times(-6.66\times10^{-5}\times(X-0.47))$$

wherein V indicates a compensation voltage to be obtained when the brightness is maximum, and X indicates the brightness detected by the brightness detector.

For instance, the brightness detector may be designed to detect a current to be supplied to the light source, in place of the brightness.

It is preferable that the compensator compensates for the compensated first and second voltages by adding a compensation voltage to the compensated first and second voltages, the compensation voltage V1 being defined in accordance with the following equation:

$$Vi=V\times(0.22\times(X+2.0))$$

wherein V indicates a compensation voltage to be obtained when the brightness is maximum, and X indicates the current detected by the brightness detector.

There is further provided a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate, (f) a plurality of opposing electrode lines arranged on the first substrate, (g) a plurality of first switches arranged at intersections of the scanning lines and the signal lines, (h) a plurality of second switches each positioned in the vicinity of each of the first switches, (i) a plurality of pixel electrodes each electrically connected to each of the first switches, and (k) a plurality of opposing electrodes each electrically connected to each of the second switches and each arranged substantially in parallel with each of the pixel electrodes.

In another aspect of the present invention, there is provided a method of driving a liquid crystal display device includes (a) a first substrate, (b) a second substrate, (c) a liquid crystal layer sandwiched between the first and second substrates, (d) a plurality of scanning lines arranged on the first substrate, (e) a plurality of signal lines arranged on the first substrate, (f) a plurality of first switches arranged at intersections of the scanning lines and the signal lines, (g) a plurality of pixel electrodes each electrically connected to each of the first switches, and (h) a plurality of opposing electrodes each arranged in parallel with each of the pixel electrodes, the method includes the steps of (a) compensating for first and second voltages such that averages of the first and second voltages in each of gradations are different from one another, and (b) outputting the thus compensated first and second voltages to the signal lines.

It is preferable that the first and second voltages are compensated for in the step (a) such that an average of the first and second voltages is smaller in a higher gradation.

It is preferable that the first and second voltages are compensated for in the step (a) such that a difference between an average of positive and negative voltages to be applied to the pixel electrode in association with a gradation and a voltage of the opposing electrode associated with the pixel electrode is kept. substantially constant irrespective of the gradation.

The method may further include the step of applying such a voltage to the opposing electrodes that a flicker is not allowed to occur in a display where pixels displaying intermediate gradation and pixels displaying black are alternately arranged.

It is preferable that the first and second voltages are compensated for in the step (a) such that a difference between an average of the first and second voltages, associated with a maximum gradation, and an average of the first and second voltages, associated with a minimum gradation, is in the range of −1.0 to 0.0 volts both inclusive, preferably in the range of −0.9 to −0.2 volts both inclusive, and more preferably in the range of −0.5 to −0.3 volts both inclusive The method may further include the step of generating first and second reference driving voltages both compensated for in each of gradations, and associated with at least one specific gradation, and wherein the step (a) includes the steps of receiving at least one pair of the first and second reference driving voltages from the reference driving voltage supplier, and calculating and outputs the first and second reference driving voltages associated with a gradation to be displayed, based on the received first and second reference driving voltages.

The method may further include the step of generating first and second reference driving voltages both compensated for in each of gradations, and wherein the step (a) includes the steps of receiving the first and second reference driving voltages from the reference driving voltage supplier, and selecting and outputs first and second reference driving voltages associated with a gradation to be displayed, among the received first and second reference driving voltages.

For instance, the step (a) may be designed to include the steps of storing first and second voltages having been compensated for in each of gradations, receiving the first and second voltages in a digital form, in association with a gradation to be displayed, outputting the thus received digital first and second voltages, receiving the digital first and second voltages, converting the thus received digital first and second voltages into analog first and second voltages, and outputting the analog first and second voltages.

For instance, the step (a) may be designed to include the steps of generating a driving voltage in accordance with a gradation to be displayed, generating a compensation voltage associated with the gradation, and adding the driving voltage and the compensation voltage to each other.

The method may further include the steps of detecting a brightness of a light reaching the liquid crystal layer, and compensating for the first and second voltages both having been once compensated for, based on the brightness detected by the brightness detector.

The advantages obtained by the aforementioned present invention will be described hereinbelow.

In accordance with the present invention, first and second voltages to be applied to signal lines are compensated for such that averages of the first and second voltages in each of gradations are different from one another. This makes it possible to avoid variance in a liquid crystal capacity, caused by variance in a gradation, and variance in field-through caused by a leakage current in thin film transistors. As a result, the present invention can prevent flickers in a display screen even if any images are displayed, and ensure high quality in displayed images.

The above and other objects and advantageous features of the present invention will be made apparent from the following description made with reference to the accompanying drawings, in which like reference characters designate the same or similar parts throughout the drawings.

BRIEF DESCRIPTION OF THE DRAWINGS

FIGS. 9A and 9D show variation in a field-through voltage.

FIG. 16 illustrates a table of reference driving voltages Va1 to Va8 in the first embodiment.

FIG. 18 illustrates a table of reference driving voltages Va1 to Va8 in a conventional liquid crystal display device.

FIG. 28 is a table showing preferable reference driving voltages and gradation compensation in each of gradations in a case where a backlight is in a minimum brightness.

FIG. 33 is a table showing measurement results in the liquid crystal display device in accordance with the first embodiment.

DESCRIPTION OF THE PREFERRED EMBODIMENTS

Before describing the liquid crystal display devices in accordance with the embodiments of the present invention, at first, a structure and an operation of an in-plane switching type liquid crystal display device in which a field is generated in parallel with substrates is explained hereinbelow, and then, the reason why flickers are generates is explained.

Figure 1:
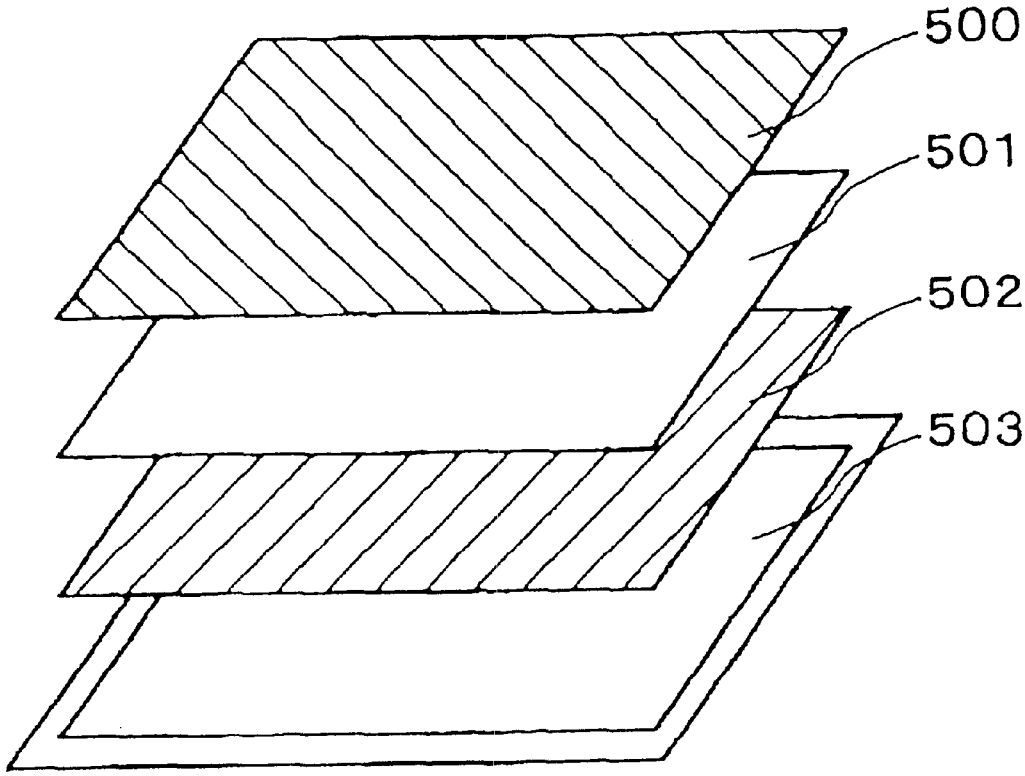
FIG. 1 is an exploded perspective view of a liquid crystal display device.

FIG. 1 is an exploded perspective view of a liquid crystal display device. As illustrated in FIG. 1, a liquid crystal display device is generally comprised of a first polarizing plate 500, a second polarizing plate 502, a liquid crystal display panel 501 sandwiched between the first and second polarizing plates 500 and 502, and a backlight unit 503 which emits a light to the liquid crystal display panel 501 through the second polarizing plate 602.

Figure 2:
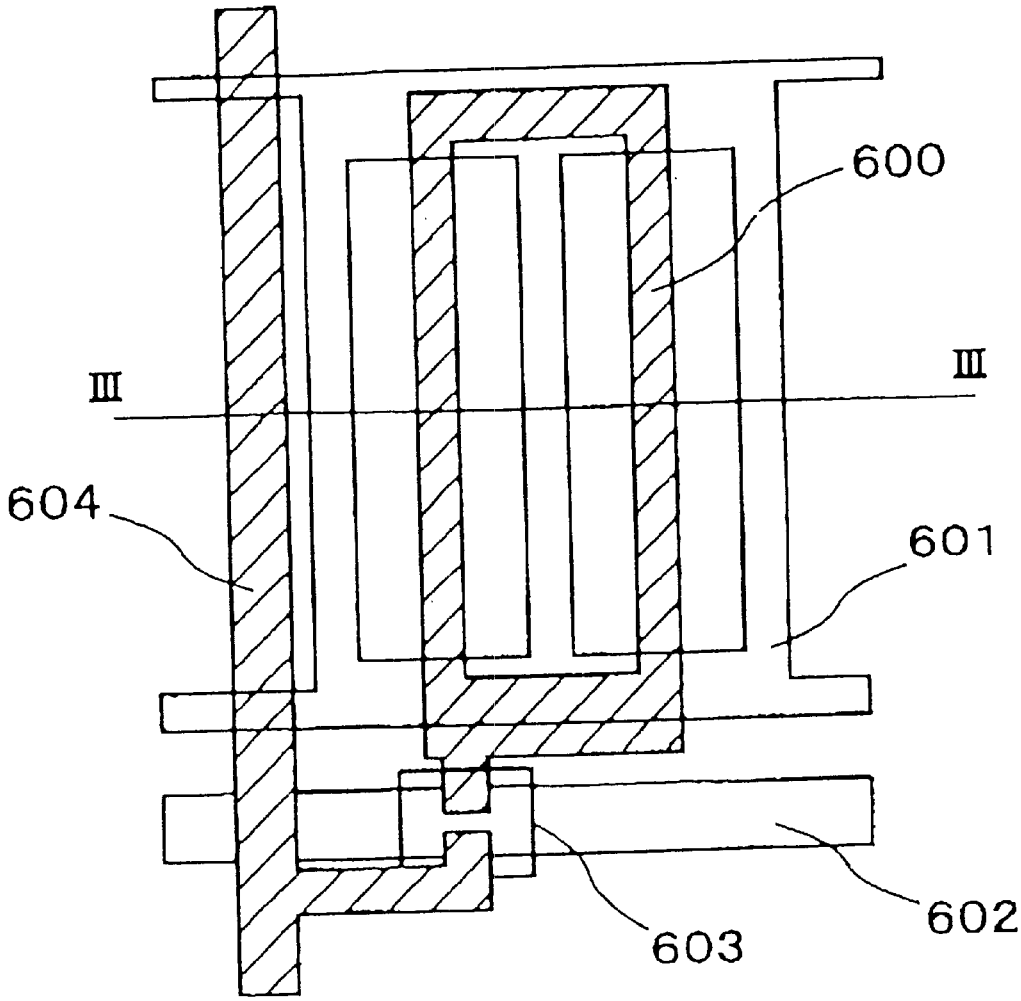
FIG. 2 is a plan view of a pixel in a liquid crystal display panel.
Figure 3:
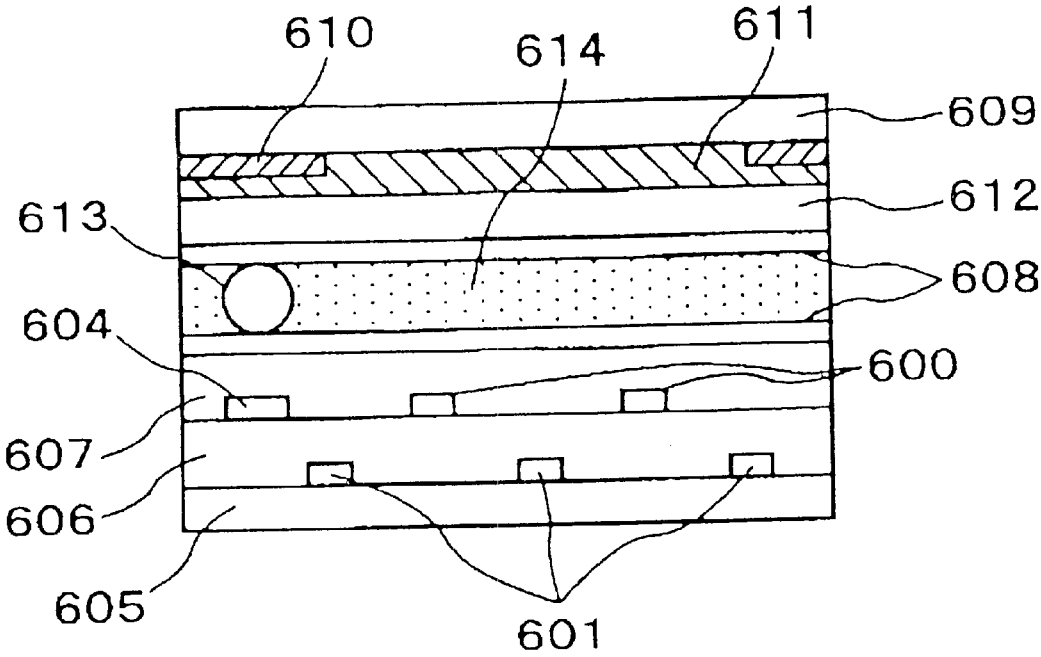
FIG. 3 is a cross-sectional view taken along the line III—III in FIG. 2.

The liquid crystal display panel 501 is explained hereinbelow with reference to FIGS. 2 and 3. FIG. 2 is a plan view of a pixel in the liquid crystal display 501, and FIG. 3 is a cross-sectional view taken along the line III—III in FIG. 2.

Opposing electrodes 601 and scanning lines 602 are formed in a predetermined pattern on a lower substrate, that is, a first transparent insulating substrate 605. For instance, the first transparent insulating substrate 605 is comprised of a glass substrate. An interlayer insulating film 606 is formed on the first transparent insulating substrate 605 covering the opposing electrodes 601 and the scanning lines 602 therewith. On the interlayer insulating film 606 are formed pixel electrodes 600 and signal lines 604 both in a pattern. The signal line 604 is electrically connected to the pixel electrode 600 through an island-shaped amorphous silicon film 603. A passivation film 607 is formed on the interlayer insulating film 606 covering the pixel electrodes 600 and the signal lines 604 therewith. An alignment film 608 is formed on the passivation film 607. The second polarizing plate 502 is adhered to a lower surface of the first transparent insulting substrate 605.

Black matrix layers 610 are formed on a lower surface of an upper substrate, that is, a second transparent insulating substrate 609. The second transparent insulating substrate 609 is composed of glass, for instance. The black matrix layers 610 disallow an incident light coming through the second transparent insulating substrate 609 to directly reach a thin film transistor, and act as a light-impermeable layer for preventing a light from leaking from a region which is located between the scanning line 602, the signal line 604 and a display area, and which does not contribute to displaying.

Between the black matrix layers 610 are formed color layers 611 defining color filters. The black matrix layers 610 and the color layers 611 are covered with an overcoating layer 612. The overcoating layer 612 is covered with an alignment film 608. The second transparent insulating substrate 609 is covered at its upper surface with an electrically conductive transparent film (not illustrated), and the first polarizing plate 500 is adhered to the electrically conductive transparent film.

The first and second transparent insulating substrates 605 and 609 are kept spaced away from each other at a fixed distance by means of spacers 613 with a liquid crystal layer 614 being hermetically sealed between the alignment films 608. Liquid crystal in the liquid crystal layer 614 is designed to have a low resistance, for instance, $4.5\times10^{10}$ Ω cm or smaller, in order to avoid afterimages which are produced when the same pattern is displayed for a long time.

A thin film transistor is fabricated in the island-shaped amorphous silicon film 603. The island-shaped amorphous silicon film 603 is formed on the interlayer insulating film 606 which is formed on the first transparent insulating substrate 605. Impurity such as phosphorus is doped into the island-shaped amorphous silicon film 603 by plasma-enhanced chemical vapor deposition (CVD), for instance, to thereby form source and drain regions. The signal line 604 is electrically connected to the drain region, and the pixel electrode 600 is electrically connected to the source region.

Figure 4A:
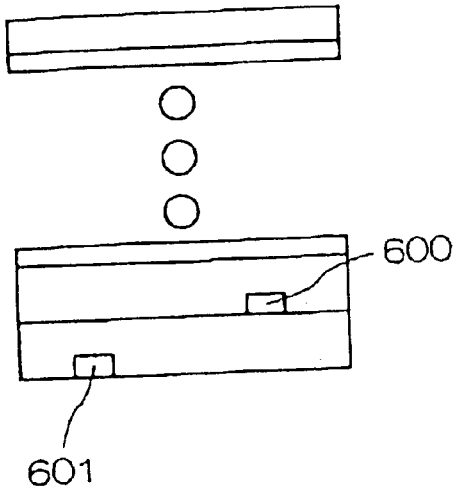
FIG. 4A is a cross-sectional view of a pixel, illustrating alignment of liquid crystal molecules when pixel and opposing electrodes are identical to each other with respect to a voltage.
Figure 4B:
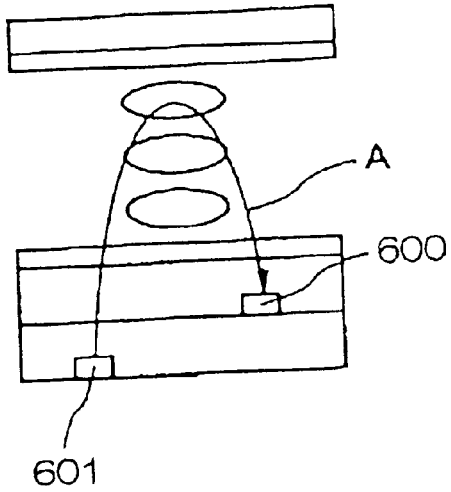
FIG. 4B is a cross-sectional view of a pixel, illustrating alignment of liquid crystal molecules when pixel and opposing electrodes are different from each other with respect to a voltage.
Figure 4C:
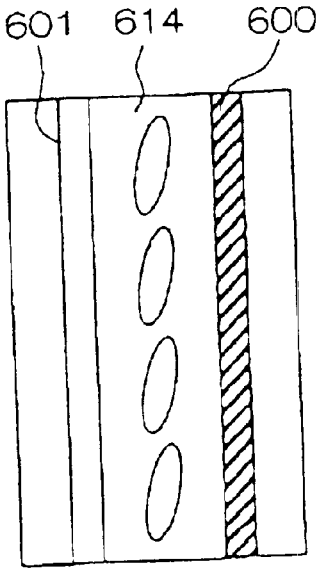
FIG. 4C is a plan view of the pixel illustrated in FIG. 4A.

Hereinbelow is explained alignment of liquid crystal molecules found when a predetermined voltage is applied to the pixel electrode 600 through the signal line 604, with reference to FIGS. 4A, 4B, 4C and 4D. FIG. 4A is a cross-sectional view of a pixel, illustrating alignment of liquid crystal molecules when the pixel and opposing electrodes 600 and 601 are identical to each other with respect to a voltage, and FIG. 4C is a plan view of the pixel illustrated in FIG. 4A. FIG. 4B is a cross-sectional view of a pixel, illustrating alignment of liquid crystal molecules when the pixel and opposing electrodes 600 and 601 are different from each other with respect to a voltage, and FIG. 4D is a plan view of the pixel illustrated in FIG. 4B.

As illustrated in FIGS. 4A and 4C, when the pixel and opposing electrodes 600 and 601 have the same voltage, a voltage is not applied thereacross, and hence, there is not generated a field.

Figure 4D:
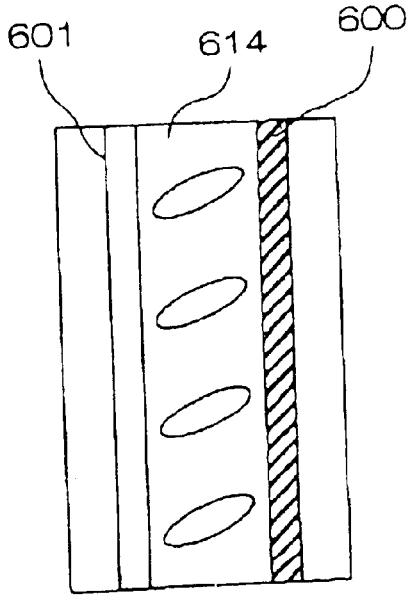
FIG. 4D is a plan view of the pixel illustrated in FIG. 4B.

In contrast, as illustrated in FIGS. 4B and 4D, when the pixel and opposing electrodes 600 and 601 have different voltages from each other, a voltage is applied thereacross, and hence, there is generated a field in accordance with the applied voltage, as indicated with an arrow A. As a result, alignment of liquid crystal molecules is varied as illustrated in FIGS. 4B and 4D, whereas alignment of liquid crystal molecules is varied as illustrated in FIGS. 4A and 4C when no voltage is applied across the pixel and opposing electrodes 600 and 601.

As mentioned above, in the in-plane switching type liquid crystal display device, a voltage determined in accordance with a gradation to be displayed is applied across the pixel electrode 600 and the opposing electrode 601 to thereby produce a field between the pixel and opposing electrodes 600 and 601 in parallel with the substrates 605 and 609, and alignment of liquid crystal molecules is varied in accordance with the thus produced field. Thus, optical characteristics of liquid crystal molecules are controlled for displaying images at a desired gradation.

Hereinbelow is explained a circuit defining a pixel in the liquid crystal display pane 501, with reference to FIG. 5.

Figure 5:
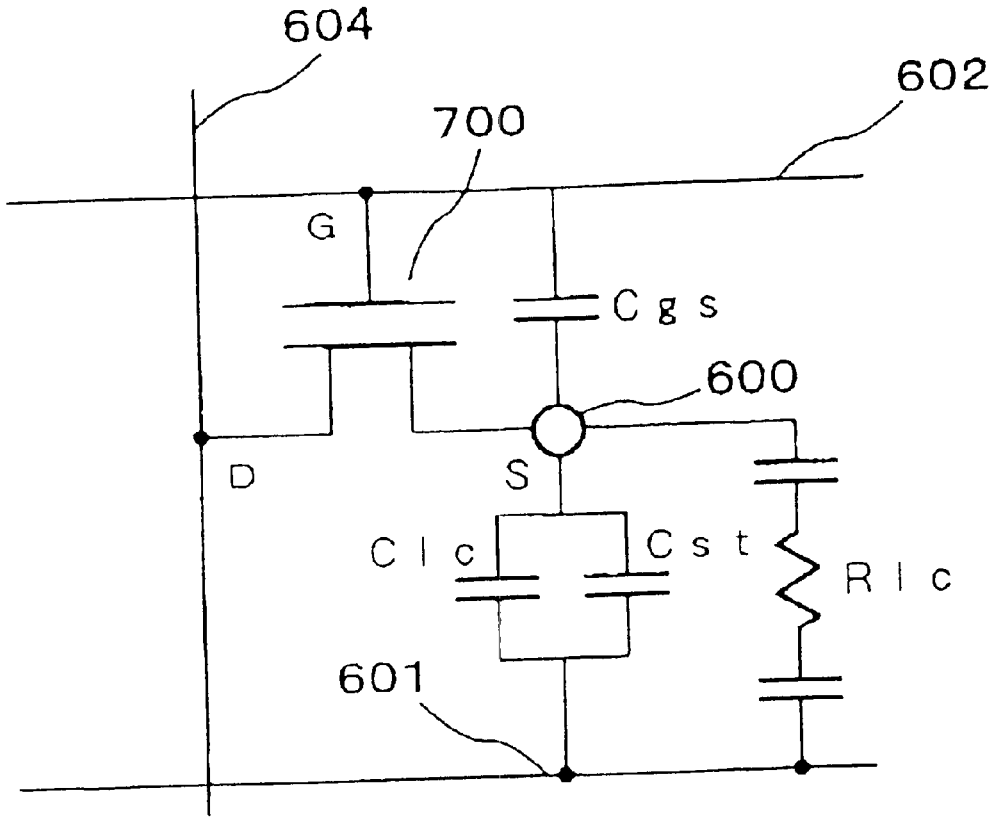
FIG. 5 is a circuit diagram of a pixel in a liquid crystal display panel.

As illustrated in FIG. 5, liquid crystal may be represented with an equivalent circuit including a liquid crystal capacity Clc, a storage capacity Cst electrically connected to the liquid crystal capacity Clc in parallel, and a liquid crystal resistance Rlc electrically connected to both the liquid crystal capacity Clc and the storage capacity Cst in parallel. The equivalent circuit is electrically connected between the pixel electrode 600 and the opposing electrode 601.

A thin film transistor 700 has a source electrically connected to the pixel electrode 600, a drain electrically connected to the signal line 604, and a gate electrically connected to the scanning line 602. A parasitic capacity Cgs is equivalently formed between the gate and source of the thin film transistor 700.

It is known that a voltage to be written into the pixel electrode 600 from the signal line 604 when the thin film transistor 700 is turned on is dropped by a certain voltage when the thin film transistor 700 is turned off. This voltage drop is caused by the parasitic capacity Cgs.

This phenomenon is called field-through. A voltage drop Vp (hereinafter, referred to as "field-through voltage") is defined in accordance with the following equation.

$$Vp=Cgs/(Cgs+Cst+Clc)\times\Delta Vg \quad (1)$$

In the equation (1), Cgs indicates a capacity between a gate electrode and a source electrode, Cst indicates a storage capacity, Clc indicates a liquid crystal capacity, and ΔVg indicates a variance in a gate voltage.

The liquid crystal capacity Clc varies in accordance with alignment of liquid crystal molecules, that is, an inclination angle of liquid crystal molecules relative to the pixel electrodes, and varies more significantly than other factors in the equation (1). Hence, the field-through voltage Vp in each of gradations is different from one another. Specifically, a field-through voltage Vp is smaller in a higher gradation, and is greater in a lower gradation.

It is said that the field-through voltage Vp is caused by the parasitic capacity Cgs between a gate and a source of a thin film transistor. Specifically, the reason why the field-through voltage Vp is generated is said that electric charges charged in the liquid crystal capacity Clc and the storage capacity Cst when the thin film transistor 700 is turned on are distributed again to the capacities when the thin film transistor 700 is turned off.

Not only the above-mentioned field-through voltage, but also a leakage current in a thin film transistor causes variance in a voltage of the pixel electrode 600.

Figure 6:
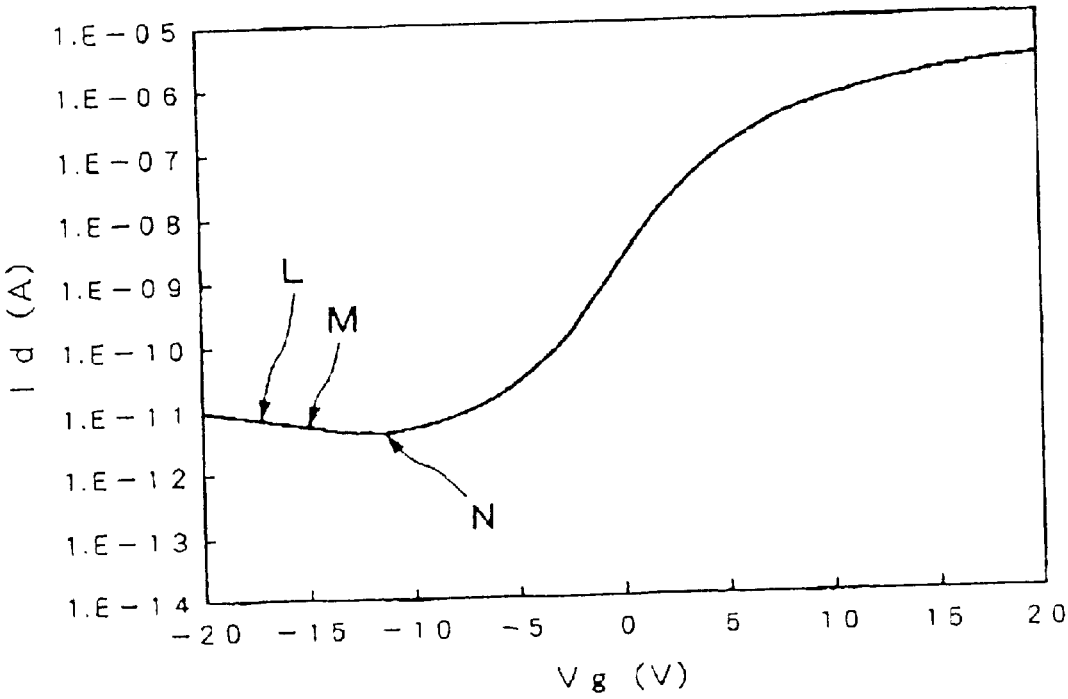
FIG. 6 is a graph showing a relation between a gate voltage and a drain voltage in a thin film transistor to which a light is radiated.

FIG. 6 shows a relation between a gate voltage and a drain current in the thin film transistor 700 to which a light is radiated. In FIG. 6, "L" indicates a leakage current when a voltage for driving a positive pole is maintained in a high gradation, "M" indicates a leakage current when a driving voltage is maintained in a low gradation, and "N" indicates a leakage current when a voltage for driving a negative pole is maintained in a high gradation.

As is obvious in view of FIG. 6, a leakage current in the thin film transistor 700 is dependent on a voltage of a pixel electrode, that is, a gradation, and is dependent further on whether a frame is a positive or negative one in a high gradation.

Figure 7:
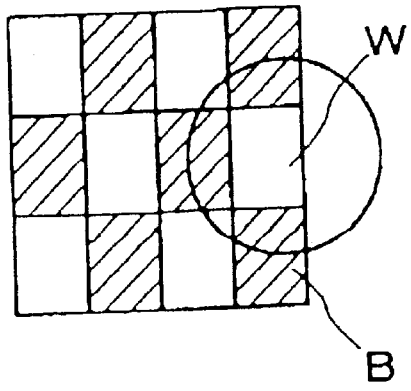
FIG. 7 illustrates a display pattern in which black-displaying pixels B and white-displaying pixels W are arranged in a checker pattern.

Herein, it is assumed that a checker pattern illustrated in FIG. 7 in which black-displaying pixels B and white-displaying pixels W are alternately arranged is displayed by dot inversion drive.

Figures 8A, 8B:
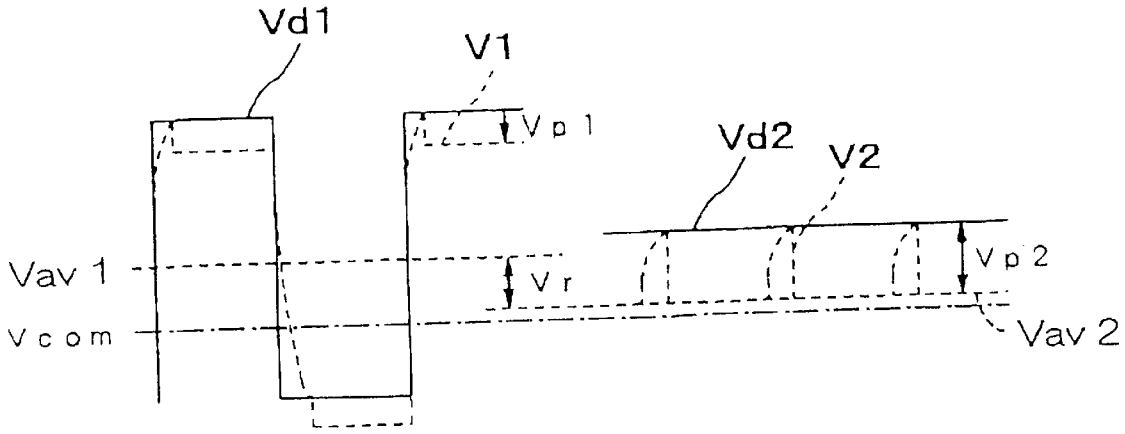
FIG. 8A illustrates a waveform of drain voltage in a high gradation.
FIG. 8B illustrates a waveform of drain voltage in a low gradation.

FIG. 8A illustrates a waveform of an input signal associated with the white-displaying pixel W, and FIG. 8B illustrates a waveform of an input signal associated with the black-displaying pixel B.

In FIG. 8A, a waveform Vd1 indicates a drain voltage which is applied to a drain of the thin film transistor 700 through the signal line 604, and a waveform V1 indicates a voltage to be actually written into the pixel electrode 600. The voltage indicated by the waveform V1 is influenced by the field-through voltage, and hence, is made lower than the drain voltage Vd1 by a field-through voltage Vd1. A waveform Vav1 indicates an average voltage to be written into the pixel electrode 600 in the white-displaying pixel W.

Similarly, in FIG. 8B, a waveform Vd2 indicates a drain voltage which is applied to a drain of the thin film transistor 700 through the signal line 604, and a waveform V2 indicates a voltage to be actually written into the pixel electrode 600. The voltage indicated by the waveform V2 is influenced by the field-through voltage, and hence, is made lower than the drain voltage Vd2 by a field-through voltage Vp2. A waveform Vav2 indicates an average voltage to be written into the pixel electrode 600 in the black-displaying pixel B.

In FIGS. 8A and 8B, Vcom indicates a voltage of the opposing electrode 601, and is constant wholly in the liquid crystal display panel.

As will be understood in view of FIGS. 8A and 8B, the average voltage Vav2 is lower than the average voltage Vav1 by a voltage Vr.

Figures 9A, 9B:
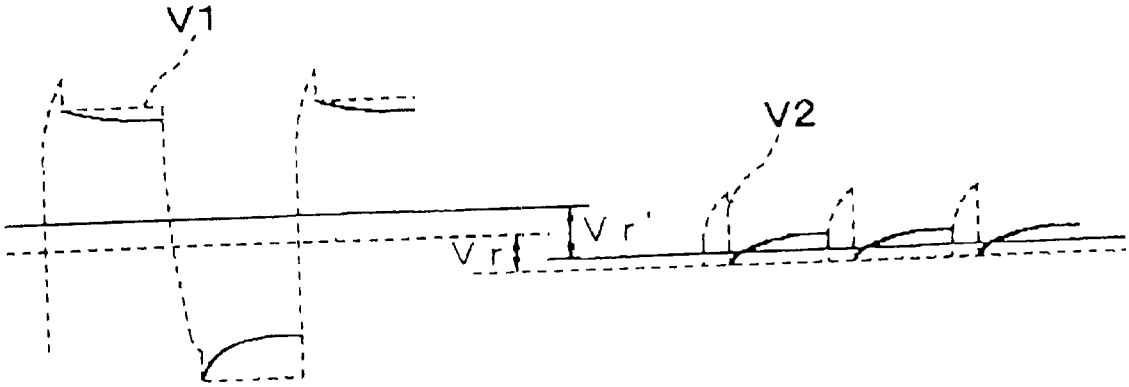

The voltages indicated by the waveforms V1 and V2, to be written into the pixel electrodes 600, illustrated in FIGS. 8A and 8B, can be represented with waveforms illustrated in FIGS. 9A and 9B, taking the above-mentioned leakage current in the thin film transistor into consideration.

That is, the pixel electrode voltages V1 and V2 to be written into the pixel electrode 600 are influenced by the leakage current in the thin film transistor, and varied accordingly. As a result, both the average voltages Vav1, and Vav2 are increased. However, since a degree of increase is remarkably varied in dependence on a gradation, a difference Vr between the average voltages V1 and V2 becomes greater. In other words, a difference Vr between the average voltages, caused by the field-through voltage and the leakage current both caused by the parasitic capacity is greater than the difference Vr between the average voltages, caused only by the field-through voltage caused by the parasitic capacity.

If average voltages in the pixel electrodes 600 are different from one another in each of pixels, this means that a dc voltage is kept applied to the pixels.

Figure 10:
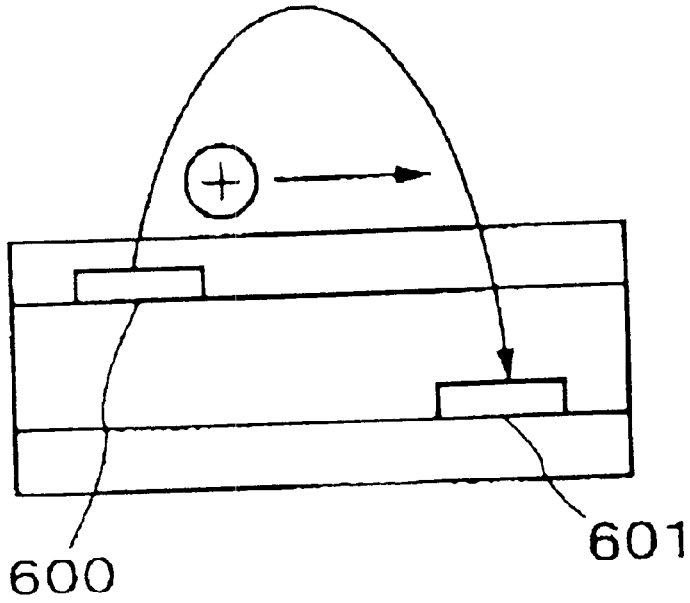
FIG. 10 illustrates a dc field generated towards an opposing electrode from a pixel electrode.

For instance, it is assumed that an average pixel voltage written into a pixel electrode in a pixel displaying images at a low gradation is a reference voltage. Under this assumption, a voltage written into a pixel electrode in a pixel displaying images at a high gradation is equal to a sum of a voltage which is to be originally written into a pixel electrode and the voltage Vr. Accordingly, even if voltages for positive and negative poles are applied to the pixel electrode, the dc voltage Vr is kept applied to the pixel electrode, resulting in that a dc field is generated towards the opposing electrode 601 to the pixel electrode 600, as illustrated in FIG. 10.

Figure 11:
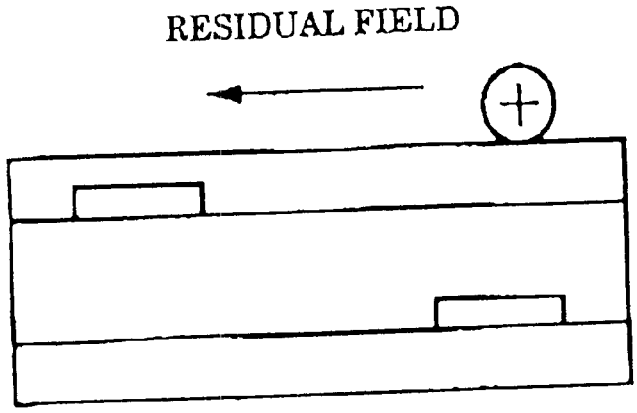
FIG. 11 illustrates a residual field.
Figure 12:
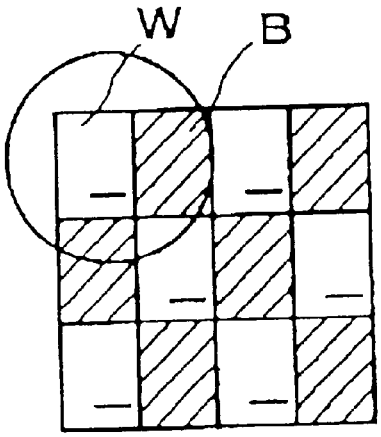
FIG. 12 illustrates electric charges remaining in pixels.

In an in-plane switching type liquid crystal display device, liquid crystal having a small resistance is used in order to reduce after-images. Accordingly, electric charges exist in a liquid crystal layer, and those electric charges are made to move by the above-mentioned dc field. As a result, a residual field which cancels the dc field is generated in the white-displaying pixel W, as illustrated in FIG. 11, resulting in that a residual field is generated in each of pixels, as illustrated in FIG. 12.

Figure 13A:
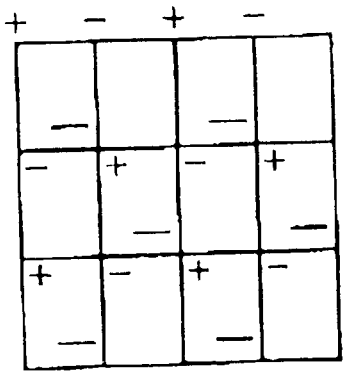
FIG. 13A illustrates a frame when a brightness is reduced.

If a picture plane is switched into another picture plane where all pixels are displayed in the same gradation with dc field being residual in the pixels, the residual field and a newly written voltage are canceled each other in a frame such as one illustrated in FIG. 13A, resulting in that the picture plane becomes dark. In contrast, the residual field and a newly written voltage are added to each other in a frame such as one illustrated in FIG. 13B, resulting in that a picture plane becomes bright.

Figure 13B:
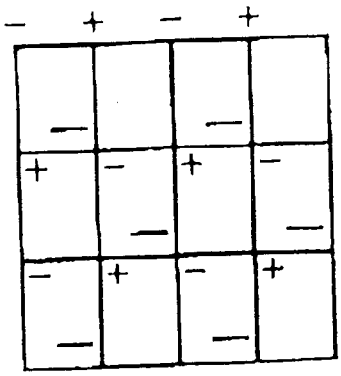
FIG. 13B illustrates a frame when a brightness is increased.
Figure 14:
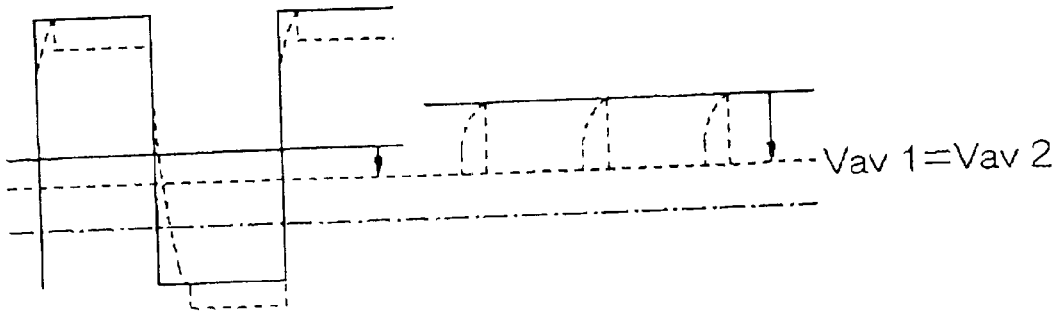
FIG. 14 illustrates a waveform obtained by compensating for a waveform of a voltage to be applied to signal lines such that averages of voltages to be applied to pixel electrodes are equal to one another in high and low gradation.

For instance, assuming that the frame illustrated in FIG. 13A is a K-th frame and the frame illustrated in FIG. 13B is a M-th frame wherein K is an odd number and M is an even number, those frames are switched at a high rate.

This causes repetition of brightness and darkness at a high rate on a picture plane. A viewer would take this phenomenon as if a picture plane flickers. This is the reason why flickers occur in a picture plane.

The reason why flickers occur has been explained above by selecting a checker pattern as illustrated in FIG. 7 as an example in which flickers occur most remarkably in a picture plane. However, it should be noted that flickers would occur, when images are displayed in different gradations for a certain period of time, and thereafter, images are displayed in all pixels in the same gradation.

Though the above-mentioned case relates to the dot inversion drive, flickers would occur even if a liquid crystal display device is driven in accordance with line inversion drive. In the dot inversion drive, since a voltage written into a pixel electrode is inverted in each of pixels, flickers would occur most remarkably, when a checker pattern as illustrated in FIG. 7 is displayed, and thereafter, an image is displayed in all the pixels in the same gradation. In contrast, since a voltage written into a pixel electrode is inverted by every line in the line inversion drive, flickers would occur most remarkably when a horizontal stripe pattern is displayed in a picture plane, and thereafter, an image is displayed in all the pixels in the same gradation.

As mentioned above, the inventor has found out that flickers would occur in a picture plane, if averages of voltages to be applied to pixel electrodes are different from one another in each gradations. In order to eliminate factors which cause such flickers as mentioned above, the inventor presented a liquid crystal display device in which a drive voltage to be output to signal lines is controlled such that a difference between an average of positive and negative pole voltages to be written into the pixel electrode 600 and a voltage of the opposing electrode 601 is substantially constant, irrespective of a gradation in which a certain image is displayed in a picture plane.

Preferred embodiments in accordance with the present invention will be explained hereinbelow with reference to drawings.

[First Embodiment]

Figure 15:
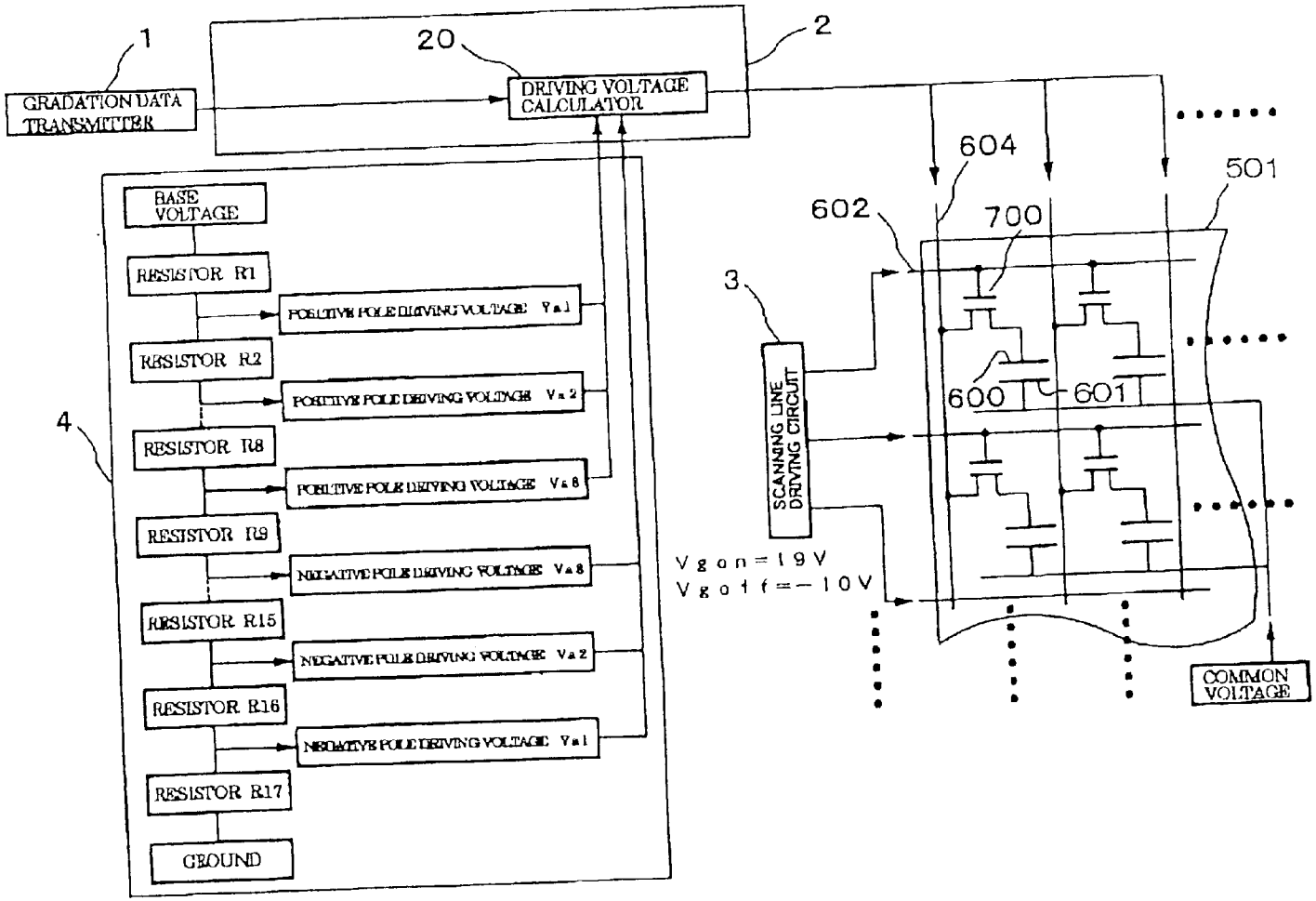
FIG. 15 is a block diagram of a liquid crystal display device in accordance with the first embodiment.

FIG. 15 is a block diagram of a liquid crystal display device in accordance with the first embodiment of the present invention. It is assumed hereinbelow that the liquid crystal display device displays an image in 256 gradations, and is driven in accordance with the dot inversion drive.

The liquid crystal display device in accordance with the first embodiment has a structure of a conventional liquid crystal display device, and further includes a gradation data transmitter 1, a circuit 2 for driving signal lines, a circuit 3 for driving scanning lines, and a circuit 4 for supplying a reference driving voltage.

The gradation data transmitter 1 outputs data indicative of a gradation to be displayed, to each of the pixels.

The signal line driving circuit 2 receives gradation data from the gradation data transmitter 1, generates a voltage in accordance with the gradation data, and outputs the voltage to an associated signal line 604 at a predetermined timing.

The scanning line driving circuit 3 successively drives the scanning lines 602 at predetermined timings. When the scanning line 602 is driven, the thin film transistor 700 located at an intersection of the scanning line 602 and the signal line 604 is turned on, and a voltage output to the signal line 604 is supplied to the pixel electrode 600 electrically connected to a source of the thin film transistor 700.

The liquid crystal display panel 601 in the first embodiment is comprised of a plurality of the pixels illustrated in FIGS. 2 and 3, arranged in a matrix.

The reference driving voltage supplying circuit 4 generates 16 reference driving voltages including reference voltages Va1 to Va8 for driving positive poles (hereinafter, a reference voltage for driving a positive pole is referred to as "a positive pole driving voltage") and reference voltages Va1 to Va8 for driving negative poles (hereinafter, a reference voltage for driving a negative pole is referred to as "a negative pole driving voltage"), by dividing a base voltage with resistors R1 to R17 electrically connected between the base voltage and a ground. The reference driving voltage supplying circuit 4 transmits the reference voltages Va1 to Va8 to a driving voltage calculator 20 constituting the signal line driving circuit 2.

The positive and negative pole driving voltages to which the same number is assigned, such as the positive pole driving voltage Va1 and the negative pole driving voltage Va1, are treated as a pair of driving voltages for displaying one gradation. This is because, since the liquid crystal display device in accordance with the first embodiment is driven in accordance with the dot inversion drive, the positive and negative pole driving voltages are required to display one gradation.

Hereinbelow, the term "reference driving voltage" indicates both the positive and negative pole driving voltages. For instance, the term "the reference driving voltage Va1" indicates both the positive pole driving voltage Va1 and the negative pole driving voltage Va1.

Figure 17:
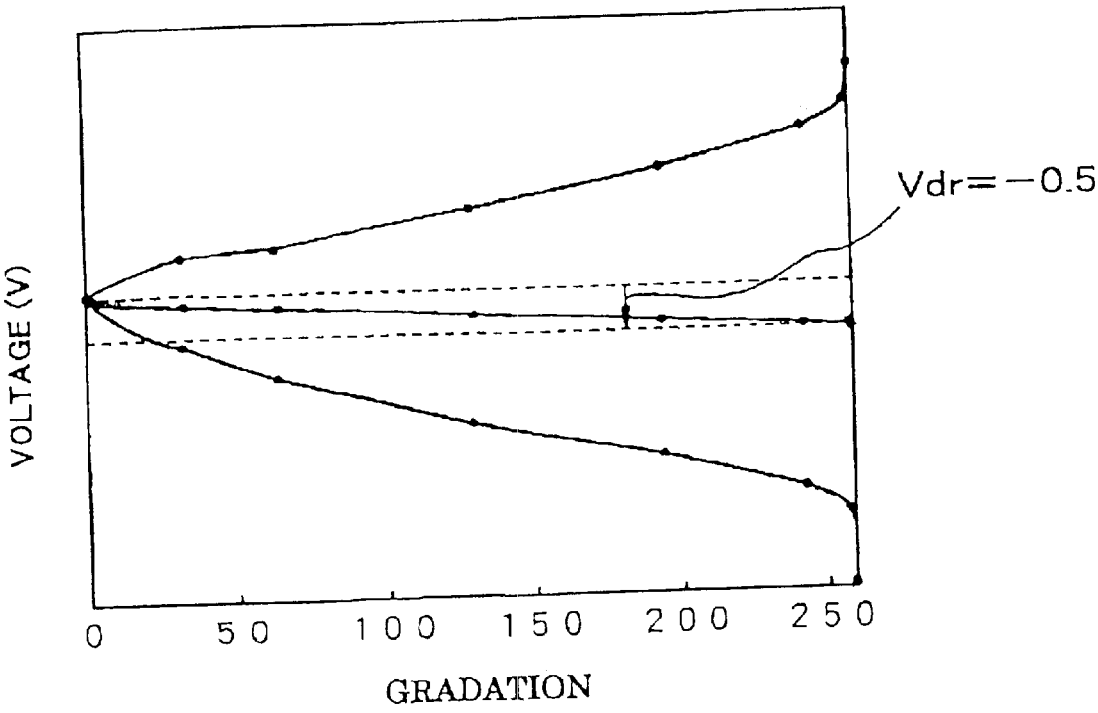
FIG. 17 is a graph showing a relation between a gradation and reference driving voltages in accordance with the table illustrated in FIG. 16.

FIG. 16 shows an example of the reference driving voltages Va1 to Va8 in the first embodiment. FIG. 17 illustrates a curve showing a relation between a gradation and a reference driving voltage, indicated in FIG. 16. FIG. 18 shows an example of conventional reference driving voltages Va1 to Va8, and FIG. 19 illustrates a curve showing a relation between a gradation and a reference driving voltage, indicated in FIG. 18.

Figure 19:
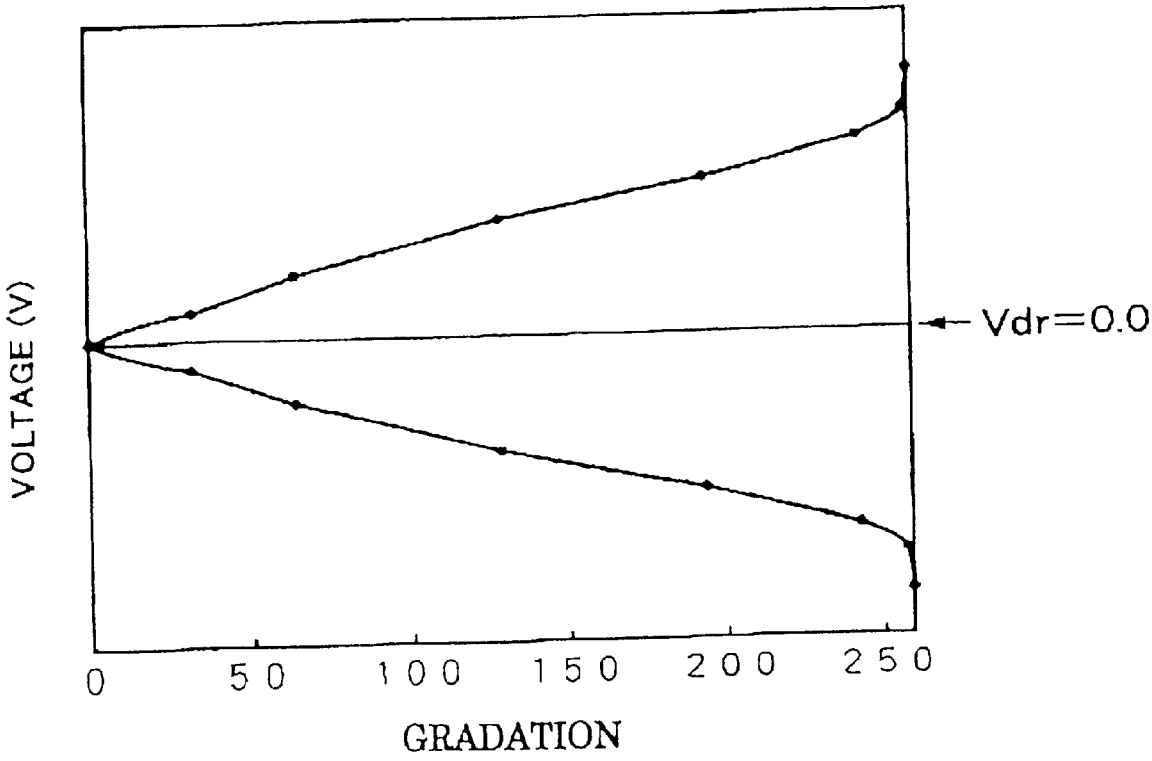
FIG. 19 is a graph showing a relation between a gradation and reference driving voltages in accordance with the table illustrated in FIG. 18.

As shown in FIGS. 18 and 19, averages of the conventional reference driving voltages are always equal to 5.8V Accordingly, a difference Vr in voltage between an average of the positive and negative pole driving voltages associated with a maximum gradation, that is, an average of the positive pole driving voltage Va1 and the negative pole driving voltage Va1 associated with 256 gradation, and an average of the positive and negative pole driving voltages associated with a minimum gradation, that is, an average of the positive pole driving voltage Va8 and the negative pole driving voltage Va8 associated with 0 gradation is equal to 0.0V, as will be obvious in view of FIG. 19.

In contrast, the reference driving voltages Va1 to Va8 in the first embodiment are compensated for such that averages of the positive and negative pole driving voltages are different from each other in each gradations, as shown in FIGS. 16 and 17. Furthermore, the reference driving voltages Va1 to Va8 are further compensated for such that an average of the positive and negative pole driving voltages is smaller in a higher gradation. How much degree the reference driving voltages Va1 to Va8 are compensated for is shown as gradation compensation in FIG. 16.

By compensating for the reference driving voltages, averages of pixel electrode voltages in each gradations, that is, averages of the positive and negative pole driving voltages to be applied to the pixel electrode 600 in each of gradations are equalized to one another.

In the first embodiment, a difference Vdr in voltage between an average of the positive and negative pole driving voltages associated with a maximum gradation, that is, an average of the positive pole driving voltage Va1 and the negative pole driving voltage Va1 associated with 255 gradation, and an average of the positive and negative pole driving voltages associated with a minimum gradation, that is, an average of the positive pole driving voltage Va8 and the negative pole driving voltage Va8 associated with 0 gradation is set in the range of −1.0 to 0.0 volts both inclusive.

Namely, the reference driving voltages Va1 to Va8 are determined so as to satisfy the following equation (2).

$$-1.0V < Vdr < 0.0V \quad (2)$$

Vdr=(positive pole driving voltage Va1+negative pole driving voltage Va1)/2—(positive pole driving voltage Va8+negative pole driving voltage Va8) /2

The voltage difference Vdr is preferably in the range of −0.9 to −0.2 volts both inclusive, and more preferably in the range of −0.5 to −0.3 volts both inclusive.

This is because the field-through voltage Vp becomes smaller in a higher gradation, and becomes greater in a lower gradation, as illustrated in FIGS. 8A and 8B.

FIG. 16 shows an example of the compensation in each of gradations, the positive pole driving voltage Va1 to Va8, and the negative pole driving voltage Va1 to Va8 in the case that a difference in voltage between an average of the positive and negative pole driving voltages associated with a maximum gradation and an average of the positive and negative pole driving voltages associated with a minimum gradation is set equal to −0.5V.

The reference driving voltage supplying circuit 4 generates the above-mentioned reference driving voltages Va1 to Va8 including the gradation compensation, and outputs the reference driving voltages Va1 to Va8 to the driving voltage calculator 20.

The driving voltage calculator 20 generates driving voltages defined by the gradation data transmitted from the gradation data transmitter 1, based on the reference driving voltages Va1 to Va8 supplied from the reference driving voltage supplying circuit 4, and outputs the thus generated driving voltages to the associated signal lines 604 at a predetermined timing.

The reference driving voltage supplying circuit 4 supplies the reference driving voltages Va1 to Va8 associated with only 8 level gradations, as illustrated in FIG. 16. Hence, a gradation which is not associated with the reference driving voltages Va1 to Va8 is produced by interpolating the 8-level reference driving voltages Va1 to Va8.

For instance, if the driving voltage calculator 20 receives the gradation 192 from the gradation data transmitter 1, the driving voltage calculator 20 selects the reference driving voltage Va4 associated the gradation 192, and outputs the positive and negative pole driving voltages associated with the reference driving voltage Va4, to the signal line 604, as the driving voltage calculator 20 switches the positive and negative pole driving voltages to each other at a predetermined timing.

If the driving voltage calculator 20 receives the gradation 200 from the gradation data transmitter 1, the driving voltage calculator 20 selects the reference driving voltage Va3 associated the gradation 240 and the reference driving voltage Va4 associated the gradation 192, and generates a driving voltage associated with the gradation 200, in accordance with the following equation (3).

$$Va4+(Va3-Va4)\times(200-192)/(240-192) \quad (3)$$

Thus, even if the reference driving voltage supplying circuit 4 does not generate driving voltages associated with all 256 gradations, the driving voltage calculator 20 can generate driving voltages associated with 256 gradations by interpolating the limited number of the reference driving voltages supplied from the reference driving voltage supplying circuit 4.

Though the 8-level reference driving voltages Va1 to Va8 are prepared in the first embodiment, the number of the prepared reference driving voltages is not to be limited to eight. If the number of the prepared reference driving voltages were increased over 8, it would be possible to display an image in a more accurate gradation. If the number of the prepared reference driving voltages is decreased below 8, it would be possible to simplify a structure of the reference driving voltage supplying circuit 4.

[Second Embodiment]

Figure 20:
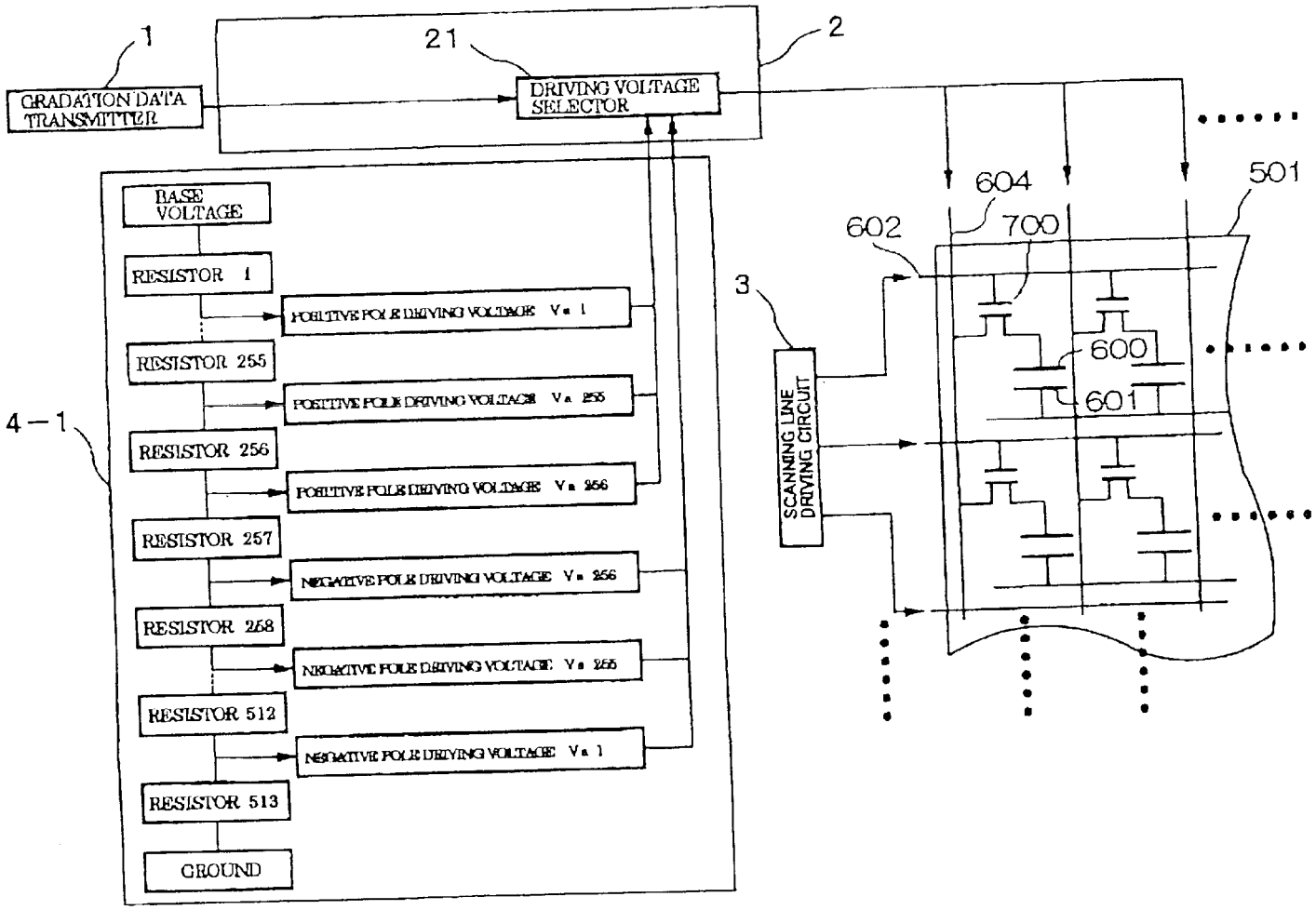
FIG. 20 is a block diagram of a liquid crystal display device in accordance with the second embodiment.

FIG. 20 is a block diagram of a liquid crystal display device in accordance with the second embodiment of the present invention.

The liquid crystal display device in accordance with the second embodiment is structurally identical with the liquid crystal display device in accordance with the first embodiment except that the reference driving voltage supplying circuit 4-1 generates driving voltages associated with all gradations, that is, 256 level gradations. Accordingly, the reference driving voltage supplying circuit 4-1 in the second embodiment generates totally 512 level voltages including 256 level positive pole driving voltages and 266 level negative pole driving voltages.

The signal line driving circuit 2 in the second embodiment is designed to include a driving voltage selector 21 in place of the driving voltage calculator 20. The driving voltage selector 21 selects a driving voltage identified with the gradation data received from the gradation data transmitter 1, among the reference driving voltages supplied from the reference driving voltage supplying circuit 4-1, and outputs the thus selected driving voltage to the associated signal line 604.

In the second embodiment, similarly to the first embodiment, a difference Vdr in voltage between an average of the positive and negative pole driving voltages associated with a maximum gradation and an average of the positive and negative pole driving voltages associated with a minimum gradation is set in the range of −1.0 to 0.0 volts both inclusive, preferably in the range of 0.9 to −0.2 volts both inclusive, and more preferably in the range of −0.5 to 0.3 volts both inclusive.

Furthermore, the reference driving voltages are selected such that an average of the positive and negative pole driving voltages is smaller in a higher gradation.

In accordance with the second embodiment, since the positive and negative driving voltages are generated in association with each of gradations, it would be possible to generate a driving voltage more accurately than the first embodiment.

[Third Embodiment]

Figure 21:
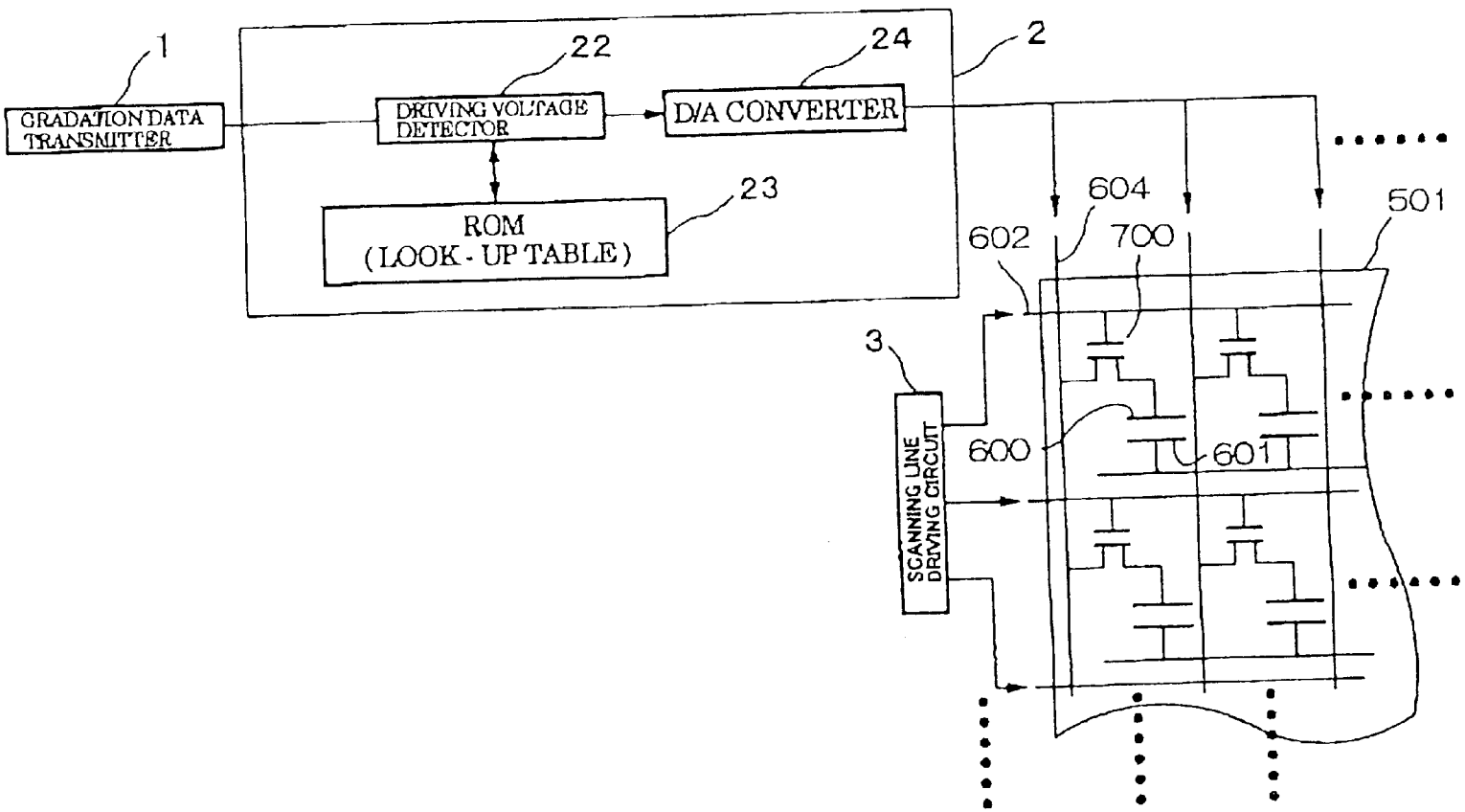
FIG. 21 is a block diagram of a liquid crystal display device in accordance with the third embodiment.

FIG. 21 is a block diagram of a liquid crystal display device in accordance with the third embodiment.

The signal line driving circuit 2 in the third embodiment is comprised of a driving voltage detector 22, a look-up table 23 comprised of a read only memory (ROM), and a digital-analog (D/A) converter 24.

The look-up table 23 stores data about the positive and negative pole driving voltages associated with each gradations. Specifically, the look-up table 23 stores therein totally 512 level driving voltages in digital form in association with each gradation data, which driving voltages include the positive and negative pole driving voltages generated by the reference driving voltage supplying circuit 4-1 in the second embodiment in association with all gradations, that is, 256 level gradations.

The driving voltage detector 22 retrieves a driving voltage associated with the gradation data transmitted from the gradation data transmitter 1, in the look-up table 23, and outputs the thus retrieved digital driving voltage to the D/A converter 24. The D/A converter 24 converts the digital driving voltage into an analog form, and then, outputs the analog driving voltage to the associated signal line 604.

In accordance with the third embodiment, since a driving voltage is treated as digital data, it would be possible to simplify a structure of the signal line driving circuit 2, and fabricate the same in a smaller size.

[Fourth Embodiment]

Figure 22:
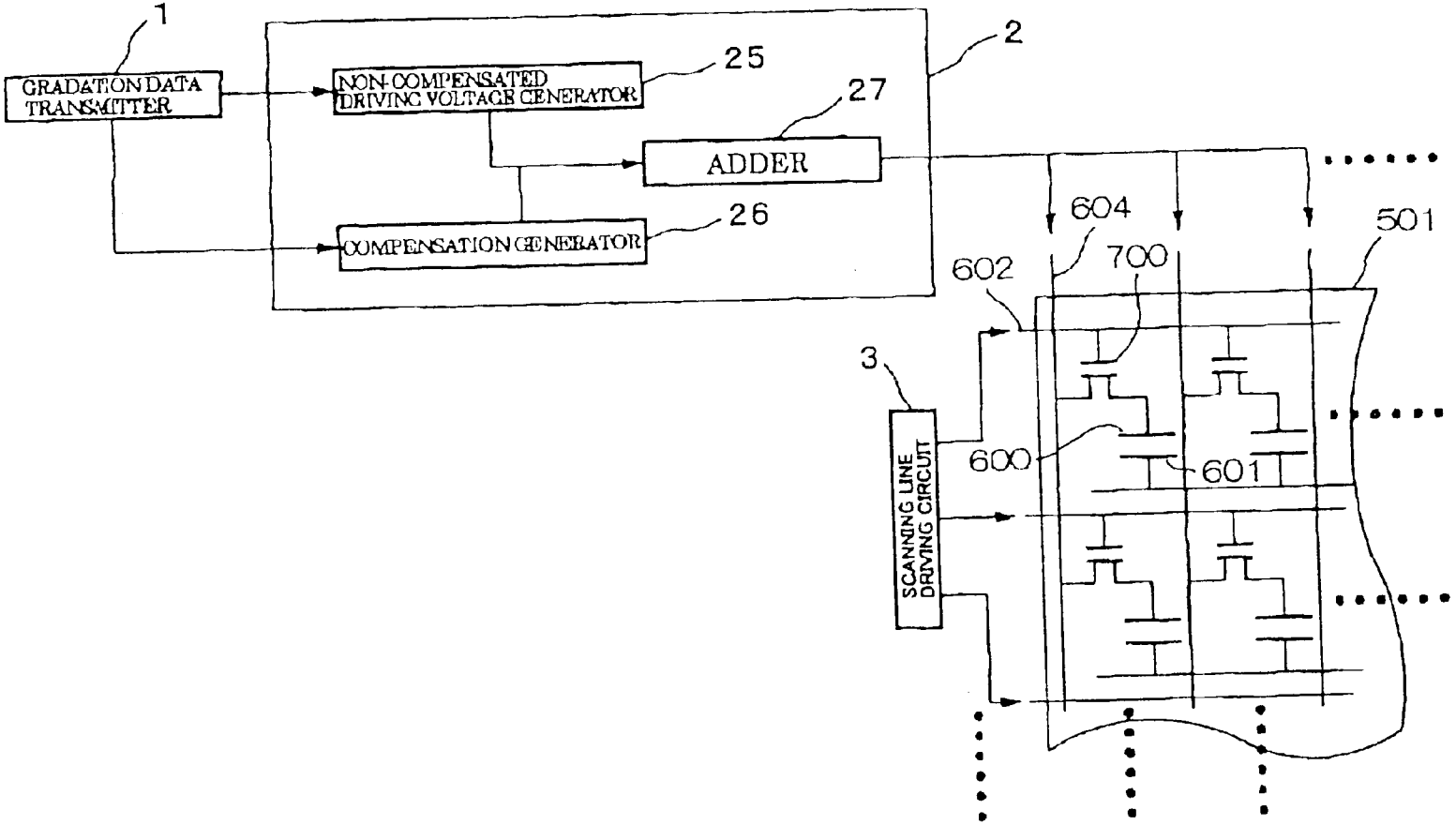
FIG. 22 is a block diagram of a liquid crystal display device in accordance with the fourth embodiment.

FIG. 22 is a block diagram of a liquid crystal display device in accordance with the fourth embodiment.

The signal line driving circuit 2 in the fourth embodiment is comprised of a non-compensated driving voltage generator 25, a compensation generator 26, and an adder 27.

In the above-mentioned first to third embodiments, the driving voltages having been compensated for in such a manner as illustrated in FIG. 16 are used as the reference driving voltages. In contrast, driving voltages having not been compensated for, as illustrated in FIG. 18 are used in the fourth embodiment.

Specifically, the non-compensated driving voltage generator 25 outputs driving voltages which are not compensated for unlike the reference driving voltages used in the first to third embodiments, and the compensation generator 26 generates a compensation in association with each of gradations. The adder 27 adds the driving voltages output from the non-compensated driving voltage generator 25 and the compensation output from the compensation generator 27 to each other to thereby transmit a driving voltage in association with each gradation.

In operation, the non-compensated driving voltage generator 25 generates a driving voltage which is not yet compensated for, in association with gradation data transmitted from the gradation data transmitter 1, and outputs the thus generated driving voltage to the adder 27. The compensation generator 26 generates a voltage in accordance with a compensation associated with gradation data transmitted from the gradation data transmitter 1, and outputs the thus generated voltage to the adder 27. The adder 27 adds the driving voltage and the compensation voltage to each other, and outputs the thus added voltages to the associated signal line 604.

As a result, the driving voltages which have been compensated for such that averages of the positive and negative pole driving voltages to be applied to the pixel electrode 600 in each of gradations are equal to one another, are output to the signal line 603, similarly to the first to third embodiments.

As mentioned above, the liquid crystal display device in accordance with the fourth embodiment is designed to include the circuit 26 for generating a compensation associated with each gradation. The compensation is added to a driving voltage which is not compensated for yet. Since a compensation associated with the same gradation is constant regardless of whether the compensation is added to a positive or negative pole driving voltage, it would be possible to simplify a structure of the signal line driving circuit 2 relative to the signal line driving circuits 2 in the first to third embodiments.

[Fifth Embodiment]

In the above-mentioned first to fourth embodiments, a voltage between the opposing electrode 601 and the pixel electrode 600 is compensated for by adding a compensation associated with each gradation to a driving voltage to be output to the signal line 604. In the fifth embodiment, a voltage of the signal line 604 is not compensated for. Instead, a second thin film transistor is formed in the opposing electrode 601 for generating a field-through voltage, and a voltage at an opposing electrode line is applied to the opposing electrode 601 through the second thin film transistor. As a result, a field-through voltage between the opposing electrode 601 and the pixel electrode 600 is canceled with the above-mentioned field-through voltage.

Figure 23:
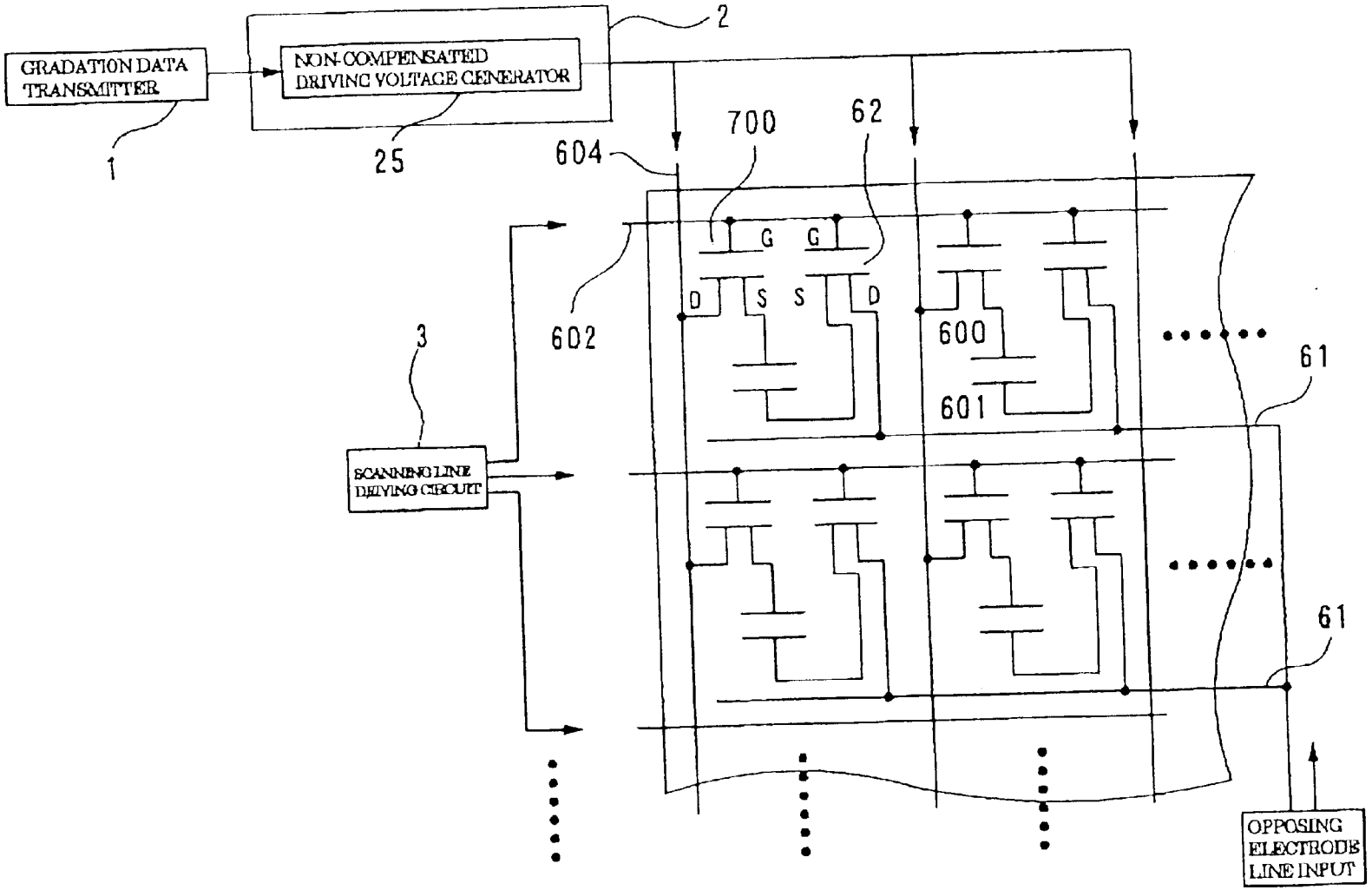
FIG. 23 is a block diagram of a liquid crystal display device in accordance with the fifth embodiment.
Figure 24:
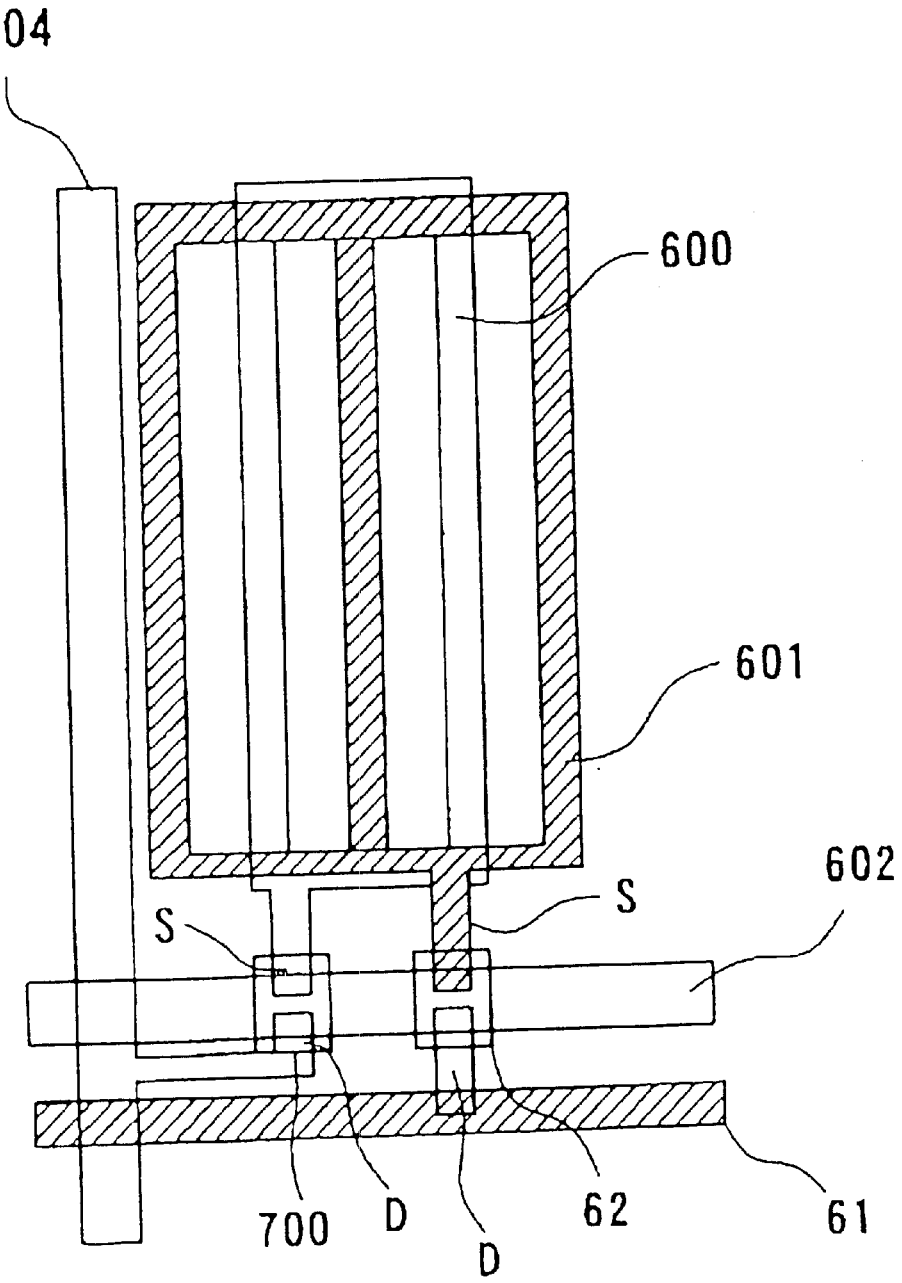
FIG. 24 is a plan view of a pixel in a liquid crystal display device in accordance with the fifth embodiment.

FIG. 23 is a block diagram of a liquid crystal display device in accordance with the fifth embodiment, and FIG. 24 is a plan view of a pixel in the fifth embodiment.

As illustrated in FIGS. 23 and 24, the liquid crystal display device in accordance with the fifth embodiment is designed to include opposing electrode lines 61 in the same number as a number of the scanning lines, and thin film transistors 61 as the second switch in the vicinity of the opposing electrode lines 61.

The thin film transistor 62 has a gate electrically connected to the scanning line 602, a drain electrically connected to the opposing electrode line 61, and a source electrically connected to the opposing electrode 601. By driving the scanning line 602, a voltage of the opposing electrode line 61 is applied to the opposing electrode 601, The opposing electrode 601 and the opposing electrode line 61 are formed at the same layer as a layer in which the scanning line 602 is formed, and the thin film transistor 62 is electrically connected to the opposing electrode 602 by forming a contact hole throughout a source electrode and electrically connected to the opposing electrode line 61 by forming a contact hole through a drain electrode.

The liquid crystal display device in accordance with the fifth embodiment is designed to include the second thin film transistor 62 to generate a field-through voltage at the opposing electrode 601 which field-through voltage is equal to the field-through voltage generated at the pixel electrode 600. A voltage to be applied to the opposing electrode line 61 through the second thin film transistor 62 is applied to the opposing electrode. Thus, when a voltage drop occurs in a voltage of the pixel electrode 600, a voltage drop also occurs at the second thin film transistor 62 by the same magnitude. As a result, there does not occur a voltage drop in the pixel electrode 600 due to the field-through voltage with respect to a relative voltage in the pixel.

In accordance with the fifth embodiment, it is no longer necessary to compensate for the positive and negative pole driving voltages unlike the above-mentioned first to fourth embodiments. Accordingly, it is no longer necessary for the signal line driving circuit 2 to include a circuit for compensating for the positive and negative pole driving voltages. Thus, it would be possible to simplify the signal line driving circuit 2, and fabricated the signal line driving circuit 2 in a smaller size. This further ensures simplification in a structure of the liquid crystal display device and a smaller size of the same.

[Sixth Embodiment]

The above-mentioned first to fifth embodiments do not refer to a brightness of backlight. However, a leakage current in a thin film transistor is influenced by a brightness of a light entering the thin film transistor. Thus, the, positive and negative pole driving voltages are compensated for, based on variance in a leakage current in the thin film transistor 700 which variance is caused by a brightness of backlight emitted from the backlight unit 503.

Figure 25:
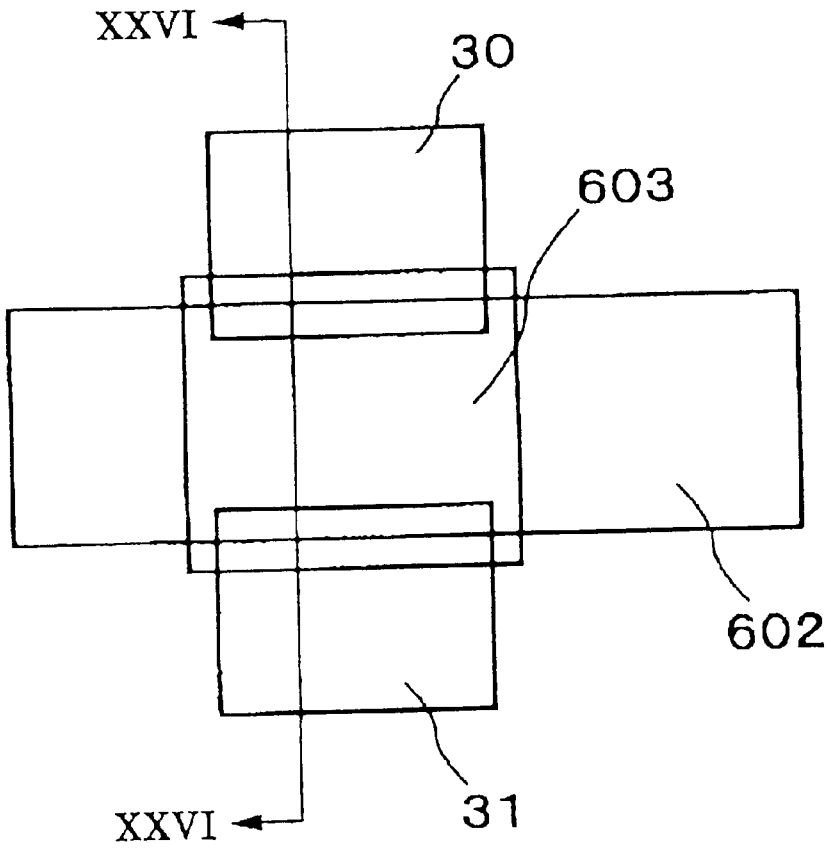
FIG. 25 is a plan view of a pixel in a liquid crystal display device in accordance with the sixth embodiment.
Figure 26:
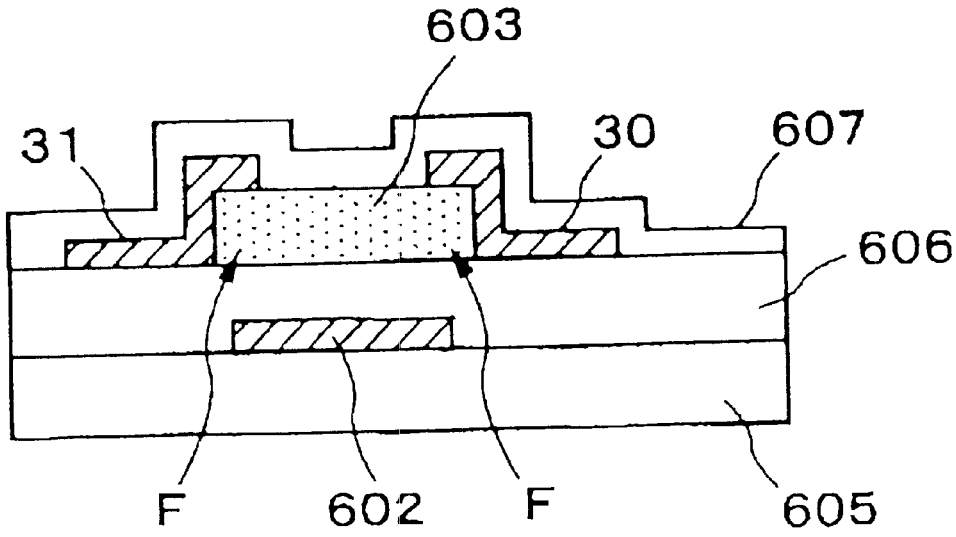
FIG. 26 is a cross-sectional view taken along the line XXVI—XXVI in FIG. 25.

FIG. 25 is a partial plan view of a region in the vicinity of the thin film transistor 700 in a pixel, and FIG. 26 is a cross-sectional view taken along the line XXVI—XXVI in FIG. 25.

With reference to FIG. 26, the scanning line 602 is formed on the first transparent insulating substrate 605 in a certain pattern. An interlayer insulating film 606 is formed on the first transparent insulating substrate 605 covering the scanning line 602 therewith. On the interlayer insulating film 606 is formed an island-shaped amorphous silicon film 603 having a greater width than a width of the scanning line 602.

By doping an impurity such as phosphorus, a source region 30 and a drain region 31 are formed around the island-shaped amorphous silicon film 603. The island-shaped amorphous silicon film 603, the source region 30 and the drain region 31 define the thin film transistor 700.

A protection insulating film 607 is formed on the interlayer insulating film 606 covering the thin film transistor 700 therewith.

In the sixth embodiment, the island-shaped amorphous silicon film 603 is designed to have a greater width than a width of the scanning line 602 formed therebelow. Hence, a light emitted from the backlight unit 503 located below the first transparent insulating substrate 605 partially enters the island-shaped amorphous silicon film 603, as illustrated with arrows F in FIG. 26. A light having entered the island-shaped amorphous silicon film 603 produces photo carriers in the island-shaped amorphous silicon film 603, and resultingly, a leakage current is generated. A leakage current is generated in a greater amount, if a light entering the island-shaped amorphous silicon film 603 had a higher brightness.

In accordance with the sixth embodiment, a compensation for a driving voltage is determined in dependence on not only a field-through voltage, but also variance in a leakage current in the thin film transistor 700 which variance is caused by a brightness of a light entering the island-shaped amorphous silicon film 603.

Figure 27:
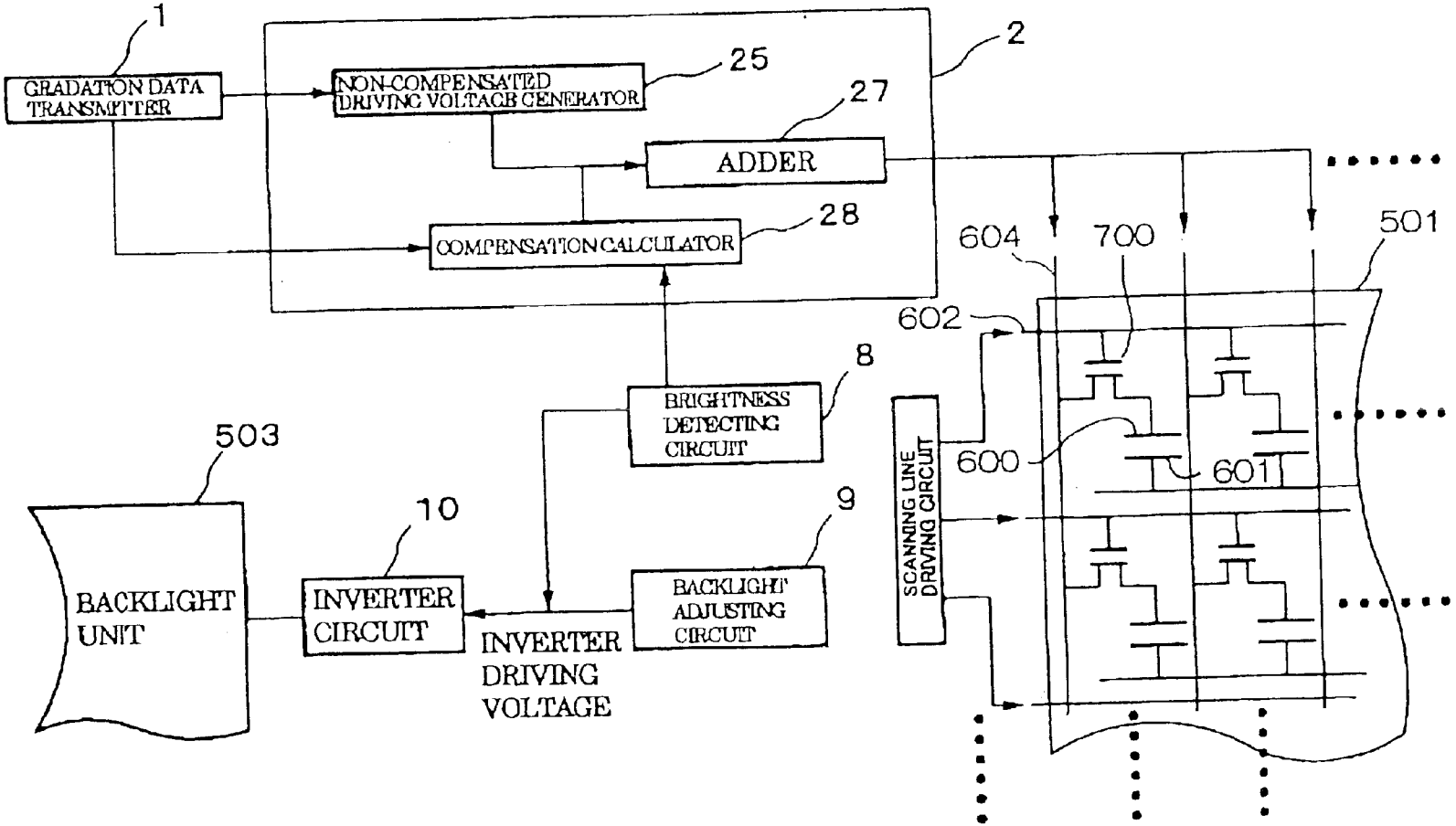
FIG. 27 is a block diagram of a liquid crystal display device in accordance with the sixth embodiment.

FIG. 27 is a block diagram of a liquid crystal display device in accordance with the sixth embodiment.

The liquid crystal display device in accordance with the sixth embodiment further includes a brightness detecting circuit 8 for outputting brightness data, a brightness adjusting circuit 9 for adjusting a brightness of backlight, and an inverter circuit 10, in comparison with the liquid crystal display device in accordance with the fourth embodiment.

The brightness adjusting circuit 9 transmits a voltage determined in accordance with a designated brightness, to the inverter circuit 10 to thereby adjust a brightness of backlight emitted from the backlight unit 503.

The brightness detecting circuit 8 detects a brightness of backlight emitted from the backlight unit 503. Specifically, the brightness detecting circuit 8 detects a current running through the inverter circuit 10, and transmits the detected current to the compensation calculator 28 which constitutes the signal line driving circuit 2. As the backlight unit 503 emits a light having a higher brightness, the brightness detecting circuit 8 detects a current in a greater amount.

The compensation calculator 28 calculates a compensation voltage Vi, based on gradation data transmitted from the gradation data transmitter 1 and brightness data, that is, a current running through the inverter 10, transmitted from the brightness detecting circuit 8.

The compensation voltage Vi is defined in accordance with the following equation (4).

$$Vi=V\times(0.22\times(X+2.0)) \quad (4)$$

In the equation (4), V indicates a compensation voltage to be obtained when a brightness of a light emitted from the backlight unit 503 is maximum, and X indicates a current detected by the brightness detecting circuit 8.

The equation (4) is established as follows.

FIG. 28 shows examples of preferable compensation voltages to be applied to driving voltages when a light emitted from the backlight unit 503 has a minimum brightness, and reference driving voltages associated with the compensation voltages.

As shown in FIG. 28, a compensation voltage associated with gradation 255 is equal to −0.3V Examples of preferable compensation voltages to be applied to driving voltages when a light emitted from the backlight unit 503 has a maximum brightness, and reference driving voltages associated with the compensation voltages were shown in FIG. 16. As shown in FIG. 16, a compensation voltage associated with gradation 255 is equal to −0.5V.

When the backlight unit 503 emits a light having a maximum brightness, the brightness detecting circuit 8 detects a current of 2.5 A. In contrast, when the backlight unit 503 emits a light having a minimum brightness, the brightness detecting circuit 8 detects a current of 0.7 A.

Figure 29:
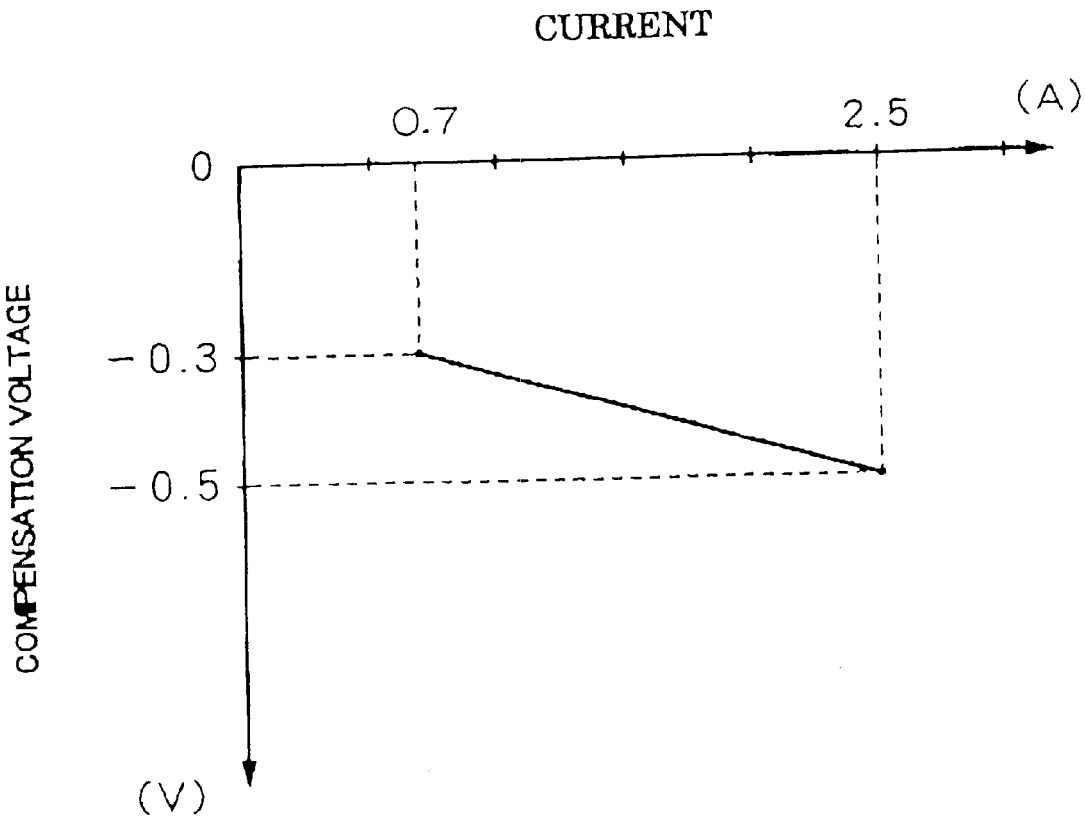
FIG. 29 is a graph showing a relation between a brightness and a gradation compensation in 255 gradations.

Since a brightness of backlight emitted from the backlight unit 503 is in proportion to a compensation voltage, there is obtained a relation between a brightness and a compensation voltage, as illustrated in FIG. 29. That is, a compensation voltage α 255 at gradation 255 in each brightness is defined in accordance with the following equation (5).

$$\alpha 255=-0.11\times(X+2.0) \quad (5)$$

The equation (5) represents the line illustrated in FIG. 29. In the equation (5), X indicates a current detected by the brightness detecting circuit 8.

Since the relation defined by the equation (5) remains the same in each of gradations, if a compensation voltage V1 in each of gradations is calculated on the basis of a maximum brightness, the compensation voltage V1 can be obtained by dividing α 255 in the equation (5) by a current detected when the backlight unit 503 emits a light having a maximum brightness, that is, −0.5, and multiplying the obtained quotient with a compensation voltage in each of gradations obtained when the backlight unit 503 emits a light having a maximum, brightness. Thus, there is obtained the equation (4).

Hereinbelow is explained an operation of the liquid crystal display device in accordance with the sixth embodiment, with reference to FIG. 27. The reference driving voltages and the compensation voltages illustrated in FIGS. 16 and 18 are used hereinbelow.

First, the gradation data transmitter 1 transmits data about gradation 200 to both the non-compensated driving voltage generator 25 and the compensation calculator 28 both constituting the signal line driving circuit 2. The brightness detecting circuit 8 transmits brightness data of 1.7 A to the compensation calculator 28.

The non-compensated driving voltage generator 25 generates a positive pole driving voltage associated with gradation 200, based on the reference driving voltage which is not yet compensated for, illustrated in FIG. 18. A driving voltage $V_{200}$ before being compensated for, associated with gradation 200, is calculated as follows in accordance with the equation (3).

$$V_{200}=8.66+(9.41-8.66)\times(200-192)/(240-192)=8.77 \quad (V)$$

The non-compensated driving voltage generator 25 generates 8.77V in accordance with the calculation result, and outputs the 8.77V to the adder 27.

The compensation calculator 28 calculates a compensation voltage without considering a brightness of backlight emitted from the backlight unit 503, based on the gradation data received from the gradation data transmitter 1, in accordance with the equation (3).

Thus, a compensation voltage $Vi_{200}$ associated with gradation 200 at a maximum brightness is calculated in accordance with the equation (3) and FIG. 16.

$$Vi_{200}=-0.3+(-0.4+0.3)\times(200-192)/(240-192)=-0.32 \quad (V)$$

Then, Vi in the equation (4) is replaced with the thus calculated $Vi_{200}$, and X is replaced with a current of 1.7 A. The compensation voltage Vi is calculated as follows.

$$Vi=-0.32\times(0.22\times(1.7+2.0))=-0.26V$$

The compensation calculator 28 transmits the thus calculated compensation voltage of −0.26 V to the adder 27.

The adder 27 adds 8.77 V transmitted from the non-compensated driving voltage generator 25 and −0.26 V transmitted from the compensation calculator 28 to each other to thereby obtain 8.51 V, and outputs the thus obtained 8.51 V to the associated signal line 604 at a predetermined timing.

In accordance with the sixth embodiment, it is possible to accurately calculate a compensation voltage by considering a brightness of backlight emitted from the backlight unit 603, as an additional parameter.

[Seventh Embodiment]

Figure 30:
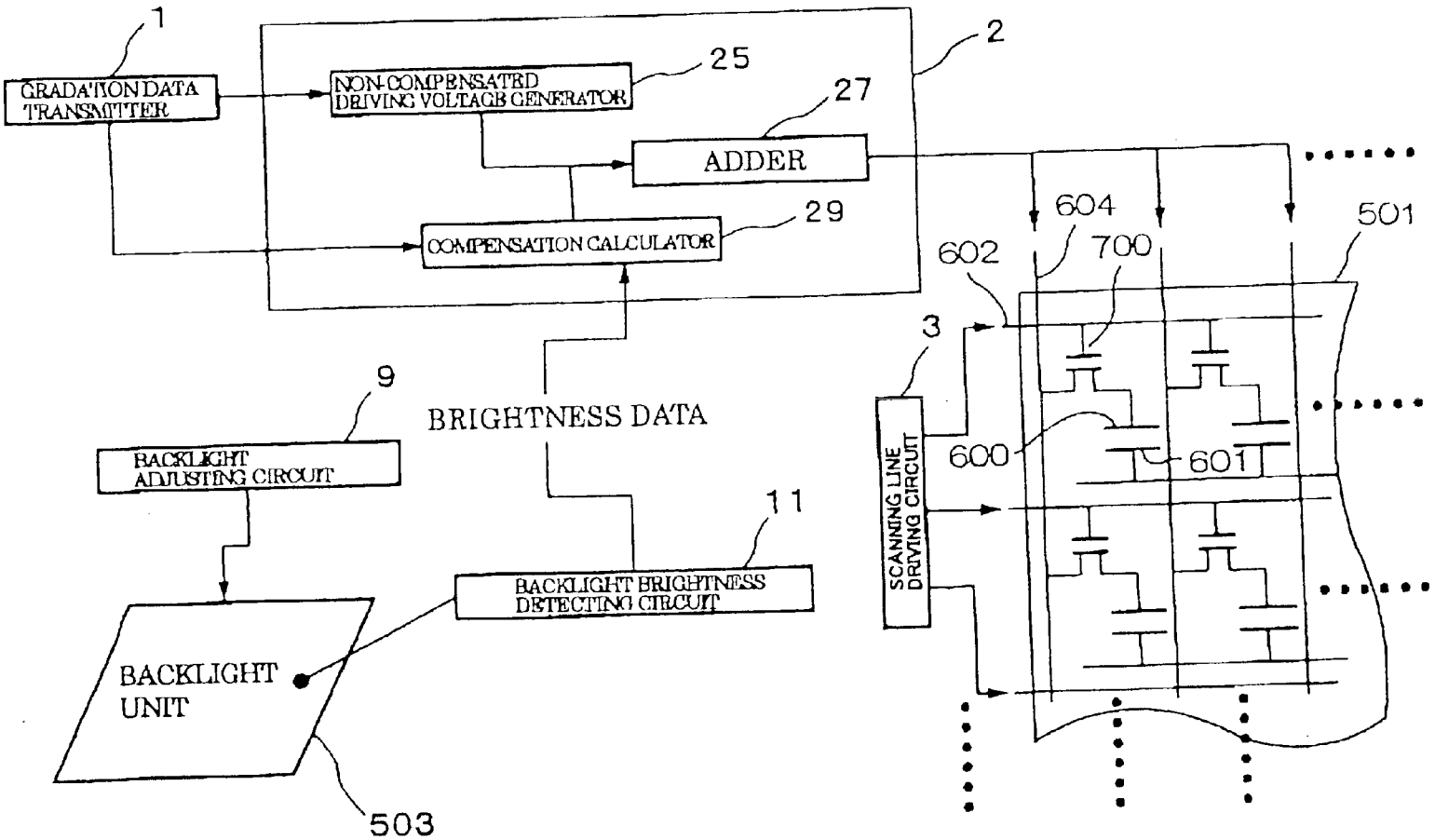
FIG. 30 is a block diagram of a liquid crystal display device in accordance with the seventh embodiment.

FIG. 30 is a block diagram of a liquid crystal display device in accordance with the seventh embodiment.

Though the liquid crystal display device in accordance with the seventh embodiment has almost the same structure as that of the liquid crystal display device in accordance with the sixth embodiment, the liquid crystal display device in accordance with the seventh embodiment detects a brightness of backlight emitted from the backlight unit 503 in a different way from the sixth embodiment.

Whereas the brightness detecting circuit 8 detects a current running through the inverter circuit 10, and transmits the detected current to the compensation calculator 28 in the sixth embodiment, the seventh embodiment includes a backlight brightness detecting circuit 11 arranged at a surface of the backlight unit 503 for measuring a brightness of backlight.

A brightness of backlight detected by the backlight brightness detecting circuit 11 is transmitted to a compensation calculator 29. Similarly to the compensation calculator 28 in the sixth embodiment, the brightness calculator 29, generates a compensation voltage in accordance with a certain equation, and outputs the thus generated compensation voltage to the adder 27.

Hereinbelow is explained the equation in accordance with which the brightness calculator 29 generates a compensation voltage.

When the backlight unit 503 emits a light having a maximum brightness, the brightness detecting circuit 11 detects a brightness of 8000 cd/m$^2$, whereas when the backlight unit 503 emits a light having a minimum brightness, the brightness detecting circuit 11 detects a brightness of 2000 cd/m$^2$. When the backlight unit 503 emits a light having a maximum brightness, the compensation voltage associated with gradation 255 is equal to −0.5V, whereas when the backlight unit 503 emits a Light having a minimum brightness, the compensation voltage associated with gradation 266 is equal to −0.3V. Using these brightnesses and voltages, similarly to the sixth embodiment, a compensation voltage β 255 at gradation 266 in each gradation is calculated in accordance with the following equation (6).

$$\beta 255=-3.33\times10^{-5}\times X-0.23 \quad (6)$$

Assuming that a maximum brightness is a reference brightness, a compensation voltage Vi in which a brightness of backlight emitted from the backlight unit 503 is defined in accordance with the following equation (7).

$$Vi=V\times(-6.66\times10^{-6}\times X-0.47) \quad (7)$$

In the equation (7), V indicates a compensation voltage in each gradation, to be obtained when a brightness of a light emitted from the backlight unit 503 is maximum, and X indicates a brightness detected by the brightness detecting circuit 11.

The compensation generator 29 calculates the compensation voltage Vi in accordance with the equation (7), based on the brightness transmitted from the brightness detecting circuit 11 and the gradation data transmitted from the gradation data transmitter 1, and outputs the thus calculated compensation voltage Vi to the adder 27.

The adder 27 adds the driving voltage which is not compensated for yet, transmitted from the non-compensated driving voltage generator 25, and the compensation voltage Vi transmitted from the compensation calculator 29 to each other, and outputs the sum to the associated signal line 604 at a predetermined timing.

[Eighth Embodiment]

A liquid crystal display device in accordance with the eighth embodiment is characterized in that a leakage current in the thin film transistor 700 is prevented from increasing due to a brightness of backlight emitted from the backlight unit 503.

Figure 31:
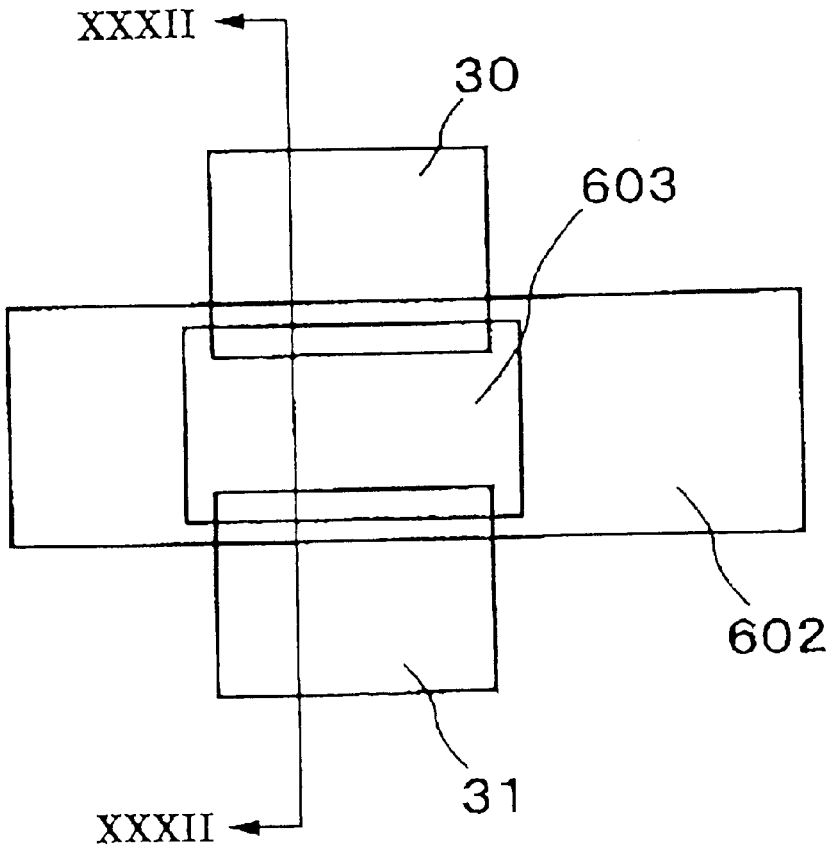
FIG. 31 is a plan view of a pixel in a liquid crystal display device in accordance with the eighth embodiment.
Figure 32:
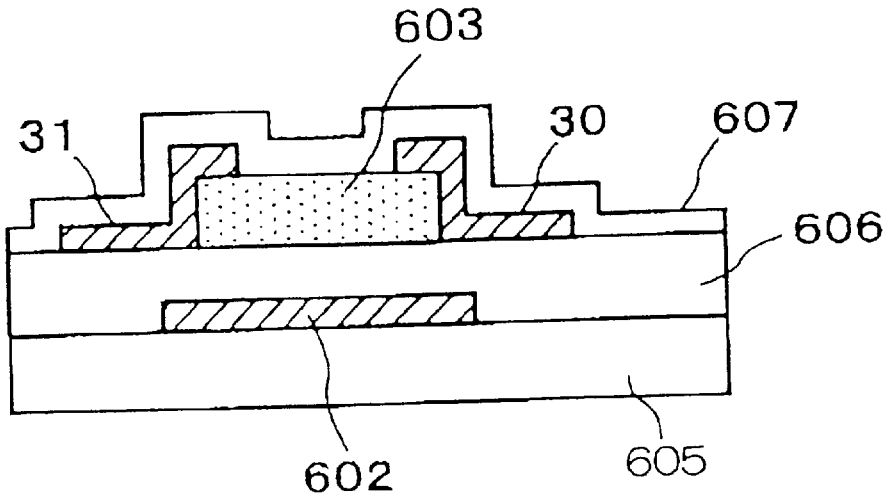
FIG. 32 is a cross-sectional view taken along the line XXXII—XXXII in FIG. 31.

FIG. 31 is a partial plan view of an area in the vicinity of the thin film transistor 700 in a pixel in the eighth embodiment, and FIG. 32 is a cross-sectional view taken along the line XXXII—XXXII in FIG. 31.

As illustrated in FIGS. 31 and 32, the scanning line 602 is designed to have a width greater than a width of the island-shaped amorphous silicon film 603 unlike the thin film transistor 700 in accordance with the sixth embodiment, illustrated in FIGS. 25 and 26. Accordingly, a light emitted from the backlight unit 503 located below the first transparent insulating substrate 605 is all interrupted by the scanning line 602, resulting in that a backlight does not enter the island-shaped amorphous silicon film 603. This ensures that photo carriers are not generated in the island-shaped amorphous silicon film 603, and hence, a leakage current is not varied due to a brightness of a light emitted from the backlight unit 503.

Accordingly, it is no longer necessary to calculate a compensation voltage on the basis of a brightness of backlight emitted from the backlight unit 503 unlike the sixth and seventh embodiments. Thus, it would be possible to accurately compensate for driving voltages without considering a brightness of backlight emitted from the backlight unit 503 by applying the eighth embodiment to the liquid crystal display devices in accordance with the above-mentioned first to fifth embodiments.

In the eighth embodiment, the reference driving voltages and the compensation voltages shown in FIG. 28 are used.

EXAMPLE 1

In Example 1, the liquid crystal display device in accordance with the first embodiment was used. The voltage difference Vdr between an average of the positive and negative pole driving voltage associated with a maximum gradation and an average of the positive and negative pole driving voltage associated with a minimum gradation was varied into six levels, specifically, −0.9V, −0.5V, −0.3V, −0.1V, 0.0V and +0.3V, and a period of time during which flickers occurred in a picture plane was measured in each of the six level voltage differences. The backlight unit 503 was designed to emit a light having a maximum brightness.

In Example 1, there were used "Digital spectrum analyzer R9211E" commercially available from Advantest Co., Ltd, and Digital Video-signal Generator VG826 commercially available from Astrodesign Co., Ltd, as a measurement unit.

In Example 1, a parasitic capacitance Cgs255 of liquid crystal associated with gradation 255 was set equal to 15.6 fF, a parasitic capacitance Cgs0 of liquid crystal associated with gradation 0 was set equal to 15.6 fF, a capacitance Clc255 between gate and source electrodes associated with gradation 255 was set equal to 75.5 fF, and a capacitance Clc0 between gate and source electrodes associated with gradation 0 was set equal to 58.8 fF. A storage capacitance Cst was set equal to 95.2 fF. A driving voltage Vgon for driving the scanning line 602 while ON was set equal to 19V, and a driving voltage Vgoff for driving the scanning line 602 while OFF was set equal to −10V.

In accordance with the equation (1), the field-through voltages Vp0 and Vp255 in pixels displaying images at 0 and 255 gradations, respectively, are calculated as follows.

Vp0=−2.67V

Vp256=−2.43V

Accordingly, a voltage difference Vdr between the filed-through voltages is calculated as follows.

$$Vdr=Vp255-Vp0=-2.43-(-2.67)=0.24V$$

A picture pattern transmitted from Digital Video-signal Generator VG826, as illustrated in FIG. 28 in which pixel each displaying at 0 gradation and pixels each displaying at 255 gradations are alternately arranged in a matrix, was displayed for 30 seconds in the liquid crystal display device in accordance with the first embodiment. Thereafter, all the pixels were switched into a picture pattern of green 127 gradation. Flickers occurring at this time in a picture plane were detected by means of a photodiode electrically connected to Digital Spectrum Analyzer R9211E, and a time until a difference between a part having a frequency of 30 Hz and a part having a frequency of 0.25 Hz became −40 db or smaller was measured. The thus measured time was treated as a time during which flickers occurred. A time during which flickers occurred was shown in FIG. 33.

It is preferable that the above-mentioned voltage difference Vdr is set smaller than −0.24V, taking influence exerted by a leakage current in the thin film transistor 700 into consideration. However, if the voltage difference Vdr is smaller than −1.0V, the compensation voltage is over the voltage difference, resulting in that a field is applied to a pixel in the opposite direction. As a result, flickers in a picture plane are deteriorated, and furthermore, there would occur sticking due to application of a dc voltage.

Accordingly based on the above-mentioned conditions and the results shown in FIG. 33, the voltage difference Vdr between an average of the positive and negative pole driving voltages to be applied to the associated signal line 604, associated with a maximum gradation, and an average of the positive and negative pole driving voltages to be applied to the associated signal line 604, associated with a minimum gradation, is necessary to be in the range of −1.0V to 0.0V both inclusive, preferably in the range of −0.9V to −0.2V both inclusive, and most preferably in the range of −0.5V to −0.3V both inclusive.

By setting the voltage difference Vdr in the above-mentioned ranges, it would be possible to minimize a time during which flickers occur in a picture plane.

The compensation voltages in each gradation to be applied to the driving voltages when the voltage difference Vdr was set equal to −0.5V were those as shown in FIG. 16.

EXAMPLE 2

In Example 2, the backlight unit 503 was designed to emit a light having a minimum brightness, specifically, a leakage current in the thin film transistor 700 was set equal to one-fourth of a leakage current observed when the backlight unit 503 emits a light having a maximum brightness, and the voltage difference Vdr was set equal to −0.3V in the liquid crystal display device in accordance with the first embodiment. A period of time during which flickers occurred in a picture plane was measured in the same way as Example 1.

A period of time during which flickers occurred was equal to or smaller than 3 seconds, which is a level a view cannot recognize unless he/she is very careful about flickers. The reference driving voltages in Example 2 were those as shown in FIG. 28.

EXAMPLE 3

In Example 1, the liquid crystal display device in accordance with the first embodiment was used. A voltage to be applied to the opposing electrode 601 was varied, and a period of time during which flickers occurred in a picture plane was measured. The backlight unit 503 was designed to emit a light having a maximum brightness.

In Example 3, there were used "Digital spectrum analyzer R9211E" commercially available from Advantest Co., Ltd, and Digital Video-signal Generator VG826 commercially available from Astrodesign Co., Ltd, as a measurement unit, similarly to Example 1.

A picture pattern transmitted from Digital Video-signal Generator VG826, as illustrated in FIG. 28 in which pixel each displaying at 0 gradation and pixels each displaying at green 127 gradations are alternately arranged in a matrix, was displayed in the liquid crystal display device in accordance with the, first embodiment. A magnitude of a part having a frequency of 30 Hz was evaluated by comparing to a part having a frequency of 0.25 Hz, by means of Digital Spectrum Analyzer R9211E.

Flickers were minimized when a voltage of the opposing electrode 601 was set equal to 3.86V, and flickers in black brightness were minimized when a voltage of the opposing electrode 601 was set equal to 3.70V. In addition, a voltage of the opposing electrode 601 was shifted when a voltage of the opposing electrode 601 was set equal to 3.50V

EXAMPLE 4

In Example 4, the liquid crystal display device in accordance with the first embodiment was used. The voltage difference Vdr was varied in the same way as Example 1, and 3.70V, 3.86V and 3.50V were applied to the opposing electrode 601 in each of the voltage differences Vdr. A period of time during which flickers occurred in a picture plane was measured in the same manner as Example 1. It was checked whether flickers were different in dependence of a voltage applied to the opposing electrode 601.

A period time during which flickers occurred was identical to the results in Example 1 in each of cases where different voltages were applied to the opposing electrode 601 in each of the voltage differences Vdr.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2000-245220 filed on Aug. 11, 2000 including specification, claims, drawings and summary is incorporated herein by reference in its entirety.

What is claimed is:

1. An in-plane switching type liquid crystal display device driven in accordance with an inversion-driving process, comprising:

(a) a first substrate;

(b) a second substrate;

(c) a liquid crystal layer sandwiched between said first and second substrates wherein liquid crystal in said liquid crystal layer has a specific resistance in the range of $4.5\times10^{10}$ Ω—cm and $2.0\times10^{13}$ Ω·cm both inclusive;

(d) a plurality of scanning lines arranged on said first substrate;

(e) a plurality of signal lines arranged on said first substrate;

(f) a plurality of first switches arranged at intersections of said scanning lines and said signal lines;

(g) a plurality of pixel electrodes each electrically connected to each of said first switches;

(h) a plurality of opposing electrodes each arranged in parallel with each of said pixel electrodes; and (i) a signal line driver which switches a first voltage for driving a positive pole and a second voltage for driving a negative pole at a predetermined interval in accordance with a gradation, and outputs said positive or negative driving voltage to said signal lines, said signal line driver compensating for said first and second voltages such that a difference between an average of said first and second voltages, associated with a maximum gradation, and an average of said first and second voltages, associated with a minimum gradation, is in the range of 0.2 to 0.9 volts both inclusive;

wherein such a voltage is applied to said opposing electrodes that a flicker is not allowed to occur in a display where pixels displaying intermediate gradation and pixels displaying black are alternately arranged.

2. The liquid crystal display device as set forth in claim 1, wherein said signal line driver compensates for said first and second voltages such that an average of said first and second voltages is smaller in a higher gradation.

3. The liquid crystal display device as set forth in claim 1, wherein said signal line driver compensates for said first and second voltages such that a difference between an average of positive and negative voltages to be applied to said pixel electrode in association with a gradation and a voltage of said opposing electrode associated with said pixel electrode is kept substantially constant irrespective of said gradation.

4. The liquid crystal display device as set forth in claim 1, wherein said signal line driver compensates for said first and second voltages such that a difference between an average of said first and second voltages, associated with a maximum gradation, and an average of said first and second voltages, associated with a minimum gradation, is in the range of 0.3 to 0.5 volts both inclusive.

5. The liquid crystal display device as set forth in claim 1, further comprising a light barrier which does not allow a light to reach said first switches.

6. The liquid crystal display device as set forth in claim 1, wherein liquid crystal in said liquid crystal layer has a specific resistance in the range of $3.0\times10^{11}$ Ω×cm and $1.0\times10^{13}$ Ω·cm both inclusive.

7. The liquid crystal display device as set forth in claim 6, wherein liquid crystal in said liquid crystal layer has a specific resistance in the range of $5.0\times10^{11}$ Ω·cm and $2.0\times10^{12}$ Ω·cm both inclusive.

8. An in-plane switching type liquid crystal display device driven in accordance with an inversion-driving process, comprising:

(a) a first substrate;

(b) a second substrate;

(c) a liquid crystal layer sandwiched between said first and second substrates wherein liquid crystal in said liquid crystal layer has a specific resistance in the range of $4.5\times10^{10}$ Ω·cm and $2.0\times10^{13}$ Ω·cm both inclusive;

(d) a plurality of scanning lines arranged on said first substrate;

(e) a plurality of signal lines arranged on said first substrate;

(f) a plurality of first switches arranged at intersections of said scanning lines and said signal lines;

(g) a plurality of pixel electrodes each electrically connected to each of said first switches;

(h) a plurality of opposing electrodes each arranged in parallel with each of said pixel electrodes;

(i) a signal line driver which switches a first voltage for driving a positive pole and a second voltage for driving a negative pole at a predetermined interval in accordance with a gradation, and outputs said positive or negative driving voltage to said signal lines; and (j) a reference driving voltage supplier which generates first and second reference driving voltages both compensated for in each of gradations, and associated with at least one specific gradation, said signal line driver compensating for said first and second voltages such that a difference between an average of said first and second voltages, associated with a maximum gradation, and an average of said first and second voltages, associated with a minimum gradation, is in the range of 0.2 to 0.9 volts both inclusive, said signal line driver including a driving voltage calculator which receives at least one pair of said first and second reference driving voltages from said reference driving voltage supplier, and calculates and outputs said first and second reference driving voltages associated with a gradation to be displayed, based on the received first and second reference driving voltages;

wherein such a voltage is applied to said opposing electrodes that a flicker is not allowed to occur in a display where pixels displaying intermediate gradation and pixels displaying black are alternately arranged.

9. The liquid crystal display device as set forth in claim 8, wherein said signal line driver compensates for said first and second voltages such that an average of said first and second voltages is smaller in a higher gradation.

10. The liquid crystal display device as set forth in claim 8, wherein said signal line driver compensates for said first and second voltages such that a difference between an average of positive and negative voltages to be applied to said pixel electrode in association with a gradation and a voltage of said opposing electrode associated with said pixel electrode is kept substantially constant irrespective of said gradation.

11. The liquid crystal display device as set forth in claim 8, wherein said signal line driver compensates for said first and second voltages such that a difference between an average of said first and second voltages, associated with a maximum gradation, and an average of said first and second voltages, associated with a minimum gradation, is in the range of 0.3 to 0.5 volts both inclusive.

12. The liquid crystal display device as set forth in claim further comprising a light barrier which does not allow a light to reach said first switches.

13. The liquid crystal display device as set forth in claim 8, wherein liquid crystal in said liquid crystal layer has a specific resistance in the range of $3.0\times10^{11}$ Ω·cm and $1.0\times10^{13}$ Ω·cm both inclusive.

14. The liquid crystal display device as set forth in claim 13, wherein liquid crystal in said liquid crystal layer has a specific resistance in the range of $5.0\times10^{11}$ Ω·cm and $2.0\times10^{12}$ Ω·cm both inclusive.

15. A method of driving an in-plane switching type liquid crystal display device driven in accordance with an inversion-driving process, comprising (a) a first substrate; (b) a second substrate; (c) a liquid crystal layer sandwiched between said first and second substrates wherein liquid crystal in said liquid crystal layer has a specific resistance in the range of $4.5\times10^{10}$ Ω·cm and $2.0\times10^{13}$ Ω·cm both inclusive; (d) a plurality of scanning lines arranged on said first substrate; (e) a plurality of signal lines arranged on said first substrate; (f) a plurality of first switches arranged at intersections of said scanning lines and said signal lines; (g) a plurality of pixel electrodes each electrically connected to each of said first switches; and (h) a plurality of opposing electrodes each arranged in parallel with each of said pixel electrodes, said method comprising the steps of:

(a) compensating for first and second voltages such that a difference between an average of said first and second voltages, associated with a maximum gradation, and an average of said first and second voltages, associated with a minimum gradation, is in the range of 0.2 to 0.9 volts both inclusive; and (b) outputting the thus compensated first and second voltages to said signal lines and (c) applying such a voltage to said opposing electrodes that a flicker is not allowed to occur in a display where pixels displaying intermediate gradation and pixels displaying black are alternately arranged.

16. The method as set forth in claim 15, wherein said first and second voltages are compensated for in said step (a) such that an average of said first and second voltages is smaller in a higher gradation.

17. The method as set forth in claim 15, wherein said first and second voltages are compensated for in said step (a) such that a difference between an average of positive and negative voltages to be applied to said pixel electrode in association with a gradation and a voltage of said opposing electrode associated with said pixel electrode is kept substantially constant irrespective of said gradation.

18. The method as set forth in claim 15, wherein said first and second voltages are compensated for in said step (a) such that a difference between an average of said first and second voltages, associated with a maximum gradation, and an average of said first and second voltages, associated with a minimum gradation, is in the range of 0.3 to 0.5 volts both inclusive.

19. The method as set forth in claim 15, further comprising the step of generating a first reference driving voltage for driving a positive pole and a second reference driving voltage for driving a negative pole both compensated for in each of gradations, and associated with at least one specific gradation, and wherein said step (a) includes the steps of receiving at least one pair of said first and second reference driving voltages from said reference driving voltage supplier, and calculating and outputs said first and second reference driving voltages associated with a gradation to be displayed, based on the received first and second reference driving voltages.

* * * * *